US011125081B2

(12) United States Patent
Slapal et al.

(10) Patent No.: US 11,125,081 B2
(45) Date of Patent: Sep. 21, 2021

(54) TERMINAL MODULES FOR DOWNHOLE FORMATION TESTING TOOLS

(71) Applicant: Schlumberger Technology Corporation, Sugar Land, TX (US)

(72) Inventors: Miroslav Slapal, London (GB); Christopher Albert Babin, Waveland, MS (US); Daniel Palmer, Muscat (OM); Kai Hsu, Sugar Land, TX (US); Anthony Robert Holmes Goodwin, Sugar Land, TX (US); Julian Pop, Houston, TX (US); Nathan Mathew Landsiedel, Sugar Land, TX (US); Adriaan Gisolf, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 594 days.

(21) Appl. No.: 15/790,689

(22) Filed: Oct. 23, 2017

(65) Prior Publication Data

US 2018/0119547 A1 May 3, 2018

Related U.S. Application Data

(60) Provisional application No. 62/415,008, filed on Oct. 31, 2016.

(51) Int. Cl.
*E21B 49/10* (2006.01)
*E21B 49/08* (2006.01)
(Continued)

(52) U.S. Cl.
CPC ..... *E21B 49/088* (2013.01); *E21B 21/10* (2013.01); *E21B 34/10* (2013.01); *E21B 49/081* (2013.01)

(58) Field of Classification Search
None
See application file for complete search history.

(56) References Cited

U.S. PATENT DOCUMENTS 7,178,591 B2 2/2007 Del Campo et al.
7,305,306 B2 12/2007 Venkataramanan et al.
(Continued)

*Primary Examiner* — Kipp C Wallace
(74) *Attorney, Agent, or Firm* — Trevor G. Grove

(57) ABSTRACT

A method includes positioning a downhole acquisition tool in a wellbore in a geological formation. The method includes operating a pump module to gather information for a fluid outside of the downhole acquisition tool that enters the downhole acquisition tool from a first flowline, a second flowline, or both while the downhole acquisition tool is within the wellbore. Operating the pump module includes controlling a valve assembly to a first valve configuration that enables the fluid to flow into the downhole tool via the first flowline fluidly coupled to a first pump module. Operating the pump module includes controlling a valve assembly to a second valve configuration that enables the fluid to flow into the downhole tool via the second flowline fluidly coupled to a second pump module, and selectively using a turnaround module or a crossover portion disposed between the first flowline and the second flowline to permit discharging the fluid from one flowline to the other flowline by actuating a valve associated with the turnaround module when the first pump module or the second pump module is not in use.

7 Claims, 22 Drawing Sheets

(51) Int. Cl.
*E21B 34/10* (2006.01)
*E21B 21/10* (2006.01)

(56) References Cited

U.S. PATENT DOCUMENTS

| | | | | |
|---|---|---|---|---|
| 7,398,159 | B2 | 7/2008 | Venkataramanan et al. | |
| 7,614,294 | B2 | 11/2009 | Hegeman et al. | |
| 7,805,988 | B2 | 10/2010 | Kasperski et al. | |
| 9,416,657 | B2 | 8/2016 | Tao et al. | |
| 9,845,673 | B2 * | 12/2017 | Gisolf | E21B 49/008 |
| 2009/0025926 | A1 * | 1/2009 | Briquet | E21B 49/10 166/105 |
| 2010/0307769 | A1 * | 12/2010 | Briquet | E21B 49/10 166/386 |
| 2012/0132419 | A1 * | 5/2012 | Zazovsky | E21B 49/008 166/264 |
| 2013/0293891 | A1 * | 11/2013 | Zazovsky | G01J 3/0267 356/402 |

* cited by examiner

TERMINAL MODULES FOR DOWNHOLE FORMATION TESTING TOOLS

CROSS-REFERENCES TO RELATED APPLICATIONS

This application claims priority to U.S. Provisional Patent Application No. 62/415,008, filed on Oct. 31, 2016, which is incorporated in its entirety by reference herein.

BACKGROUND

This disclosure relates to systems and methods to reduce the number of independent modules and other equipment (e.g., valves) used in the downhole acquisition tools.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

A variety of systems are used in geophysical exploration and production operations to determine chemical and physical parameters of materials drawn in through a wellbore. Fluid analyses typically include, but are not limited to, the determination of oil, water and gas constituents of the fluid. It may be desirable to obtain multiple fluid analyses or samples as a function of depth within the wellbore. Operationally, it may be desirable to obtain these multiple analyses or samples during a single trip of the tool within the wellbore.

Formation testing tools can be conveyed through the wellbore by variety of means including, but not limited to, a drill string, a permanent completion string, or a string of coiled tubing. Formation testing tools may be designed for wireline usage or as part of a drill string. Conventional formation testing tools may utilize several modules and may utilize several flow control devices (e.g., valves), thereby increasing the overall size of the tool.

SUMMARY

This summary is provided to introduce a selection of concepts that are further described below in the detailed description. This summary is not intended to identify key or essential features of the subject matter described herein, nor is it intended to be used as an aid in limiting the scope of the subject matter described herein. Indeed, this disclosure may encompass a variety of aspects that may not be set forth below.

In one example, a method includes positioning a downhole acquisition tool in a wellbore in a geological formation. The method includes operating a pump module to gather information for a fluid outside of the downhole acquisition tool that enters the downhole acquisition tool from a first flowline, a second flowline, or both while the downhole acquisition tool is within the wellbore. Operating the pump module includes controlling a valve assembly to a first valve configuration that enables the fluid to flow into the downhole tool via the first flowline fluidly coupled to a first pump module. Operating the pump module includes controlling a valve assembly to a second valve configuration that enables the fluid to flow into the downhole tool via the second flowline fluidly coupled to a second pump module, and selectively using a turnaround module or a crossover portion disposed between the first flowline and the second flowline to permit discharging the fluid from one flowline to the other flowline by actuating a valve associated with the turnaround module when the first pump module or the second pump module is not in use.

In another example, a system includes a downhole acquisition tool housing configured to receive a fluid that enters the downhole acquisition tool from a first flowline, a second flowline, or both. A flow control assembly includes a turnaround module, a first flowline fluidly coupled to a first pump module, a second flowline fluidly coupled to a second pump module, and a crossover portion disposed between the first pump module and the second pump module, where the flow control assembly permits discharging the fluid from the first flowline to the second flowline, where the flow control system includes one or more tangible, non-transitory, machine-readable media comprising instructions. The instructions control a valve assembly of a first valve configuration that enables the fluid to flow into the downhole tool via the first flowline toward a first pump module, control a valve assembly of a second valve configuration that enables the fluid to flow into the downhole tool via the second flowline toward a second pump module, and selectively use the turnaround module or the crossover portion to direct the fluid flow between the first flowline and the second flowline by actuating a valve associated with the turnaround module when the first pump module or the second pump module is not in use.

In another example, a system includes a downhole acquisition tool housing configured to receive a fluid that enters the downhole acquisition tool from a first flowline, a second flowline, or both and a turnaround module. The system includes a first flowline fluidly coupled to a first pump module, and a second flowline fluidly coupled to the first pump module, where the turnaround module permits discharging the fluid from the first flowline to the second flowline. The system includes one or more tangible, non-transitory, machine-readable media comprising instructions to control a valve assembly of a first valve configuration that enables the fluid to flow into the downhole tool via the first flowline toward the first pump module. The instructions control a valve assembly of a second valve configuration that enables the fluid to flow into the downhole tool via the second flowline toward the first pump module. The instructions selectively use the turnaround module to direct the fluid flow along the first or the second flowlines to inflate a packer assembly by actuating a valve associated with the turnaround module.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
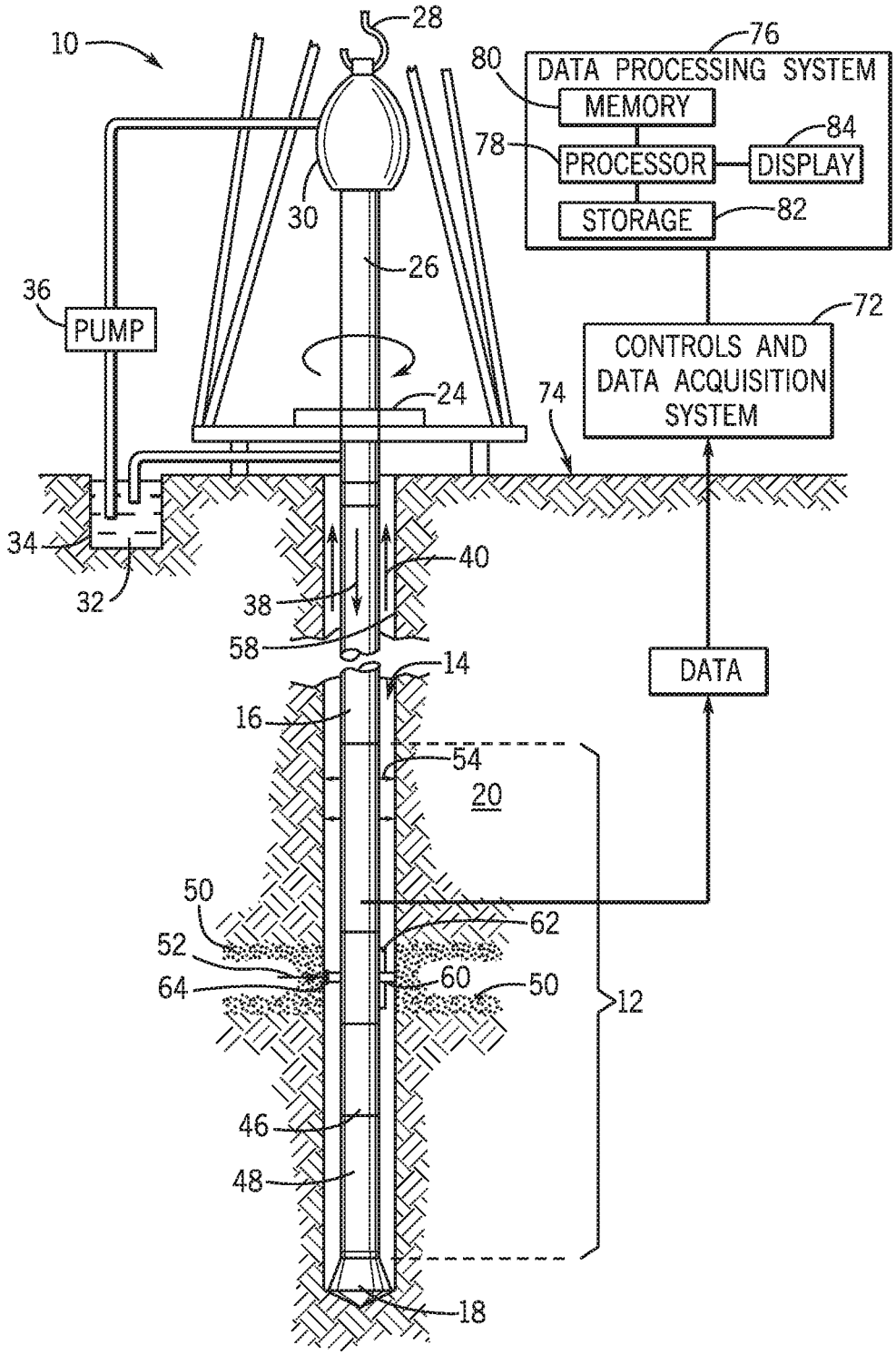
FIG. 1 is a schematic diagram of a logging-while-drilling wellsite system that may be used to identify properties of formation fluids in the wellbore, in accordance with an embodiment.

One or more specific embodiments of the present disclosure will be described below. These described embodiments are examples of the presently disclosed techniques. Additionally, in an effort to provide a concise description of these embodiments, features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure relates to systems and methods of a formation evaluation system including a downhole tool positionable in a wellbore penetrating a subterranean formation having a formation fluid therein. The system is provided with a first and a second inlet for receiving the fluids from the formation, a first and a second evaluation flowline (e.g., the sample line and the guard line) fluidly coupled to at the first and the second inlets for passage of the formation fluid into the downhole tool, and at least one turnaround module coupled to at least one first or the second evaluation flowlines for passage of the formation fluid into the downhole tool.

In another aspect, the disclosure relates to a method of drawing fluid into a downhole tool positionable in a wellbore penetrating a formation having a formation fluid therein. The method involves establishing fluid communication between a first and a second inlet and the formation, establishing fluid communication between a first and a second inlet and a first and a second evaluation flowline, pumping fluid into the first evaluation flowline via a first pump module, pumping fluid into the second evaluation flowline via a second pump module, and using the at least one turnaround module for routing fluid in the first evaluation flowline with the second pump module or routing fluid in the second evaluation flowline with the first pump module. The disclosed embodiments may reduce the number of independent modules and other equipment (e.g., valves) used in the downhole acquisition tool when compared to conventional tools.

Figure 2:
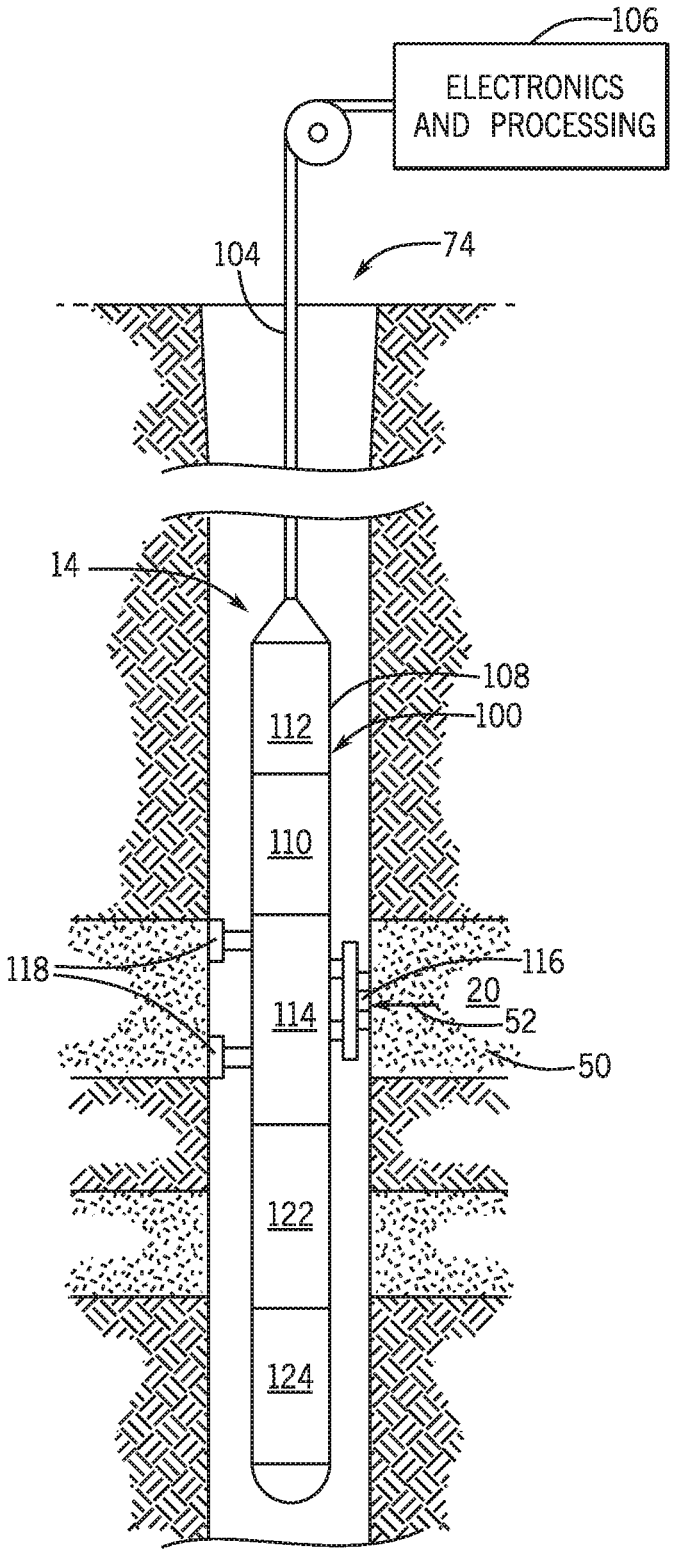
FIG. 2 is a schematic diagram of another example of a wireline wellsite system that may be used to identify properties of the formation fluids in the wellbore, in accordance with an embodiment.

FIGS. 1 and 2 depict examples of wellsite systems that may employ such fluid analysis systems and methods. In FIG. 1, a rig 10 suspends a downhole acquisition tool 12 into a wellbore 14 via a drill string 16. A drill bit 18 drills into a geological formation 20 to form the wellbore 14. The drill string 16 is rotated by a rotary table 24, which engages a kelly 26 at the upper end of the drill string 16. The drill string 16 is suspended from a hook 28, attached to a traveling block, through the kelly 26 and a rotary swivel 30 that permits rotation of the drill string 16 relative to the hook 28. The rig 10 is depicted as a land-based platform and derrick assembly used to form the wellbore 14 by rotary drilling. However, in other embodiments, the rig 10 may be an offshore platform.

Drilling fluid referred to as drilling mud 32, is stored in a pit 34 formed at the wellsite. A pump 36 delivers the drilling mud 32 to the interior of the drill string 16 via a port in the swivel 30, inducing the drilling mud 32 to flow downwardly through the drill string 16 as indicated by a directional arrow 38. The drilling mud 32 exits the drill string 16 via ports in the drill bit 18, and then circulates upwardly through the region between the outside of the drill string 16 and the wall of the wellbore 14, called the annulus, as indicated by directional arrows 40. The drilling mud 32 lubricates the drill bit 18 and carries formation cuttings up to the surface as it is returned to the pit 34 for recirculation.

The downhole acquisition tool 12, sometimes referred to as a component of a bottom hole assembly ("BHA"), may be positioned near the drill bit 18 and may include various components with capabilities such as measuring, processing, and storing information, as well as communicating with the surface. Additionally or alternatively, the downhole acquisition tool 12 may be conveyed on wired drill pipe, a combination of wired drill pipe and wireline, or other suitable types of conveyance.

The downhole acquisition tool 12 may further include a fluid communication module 46, a sampling module 48, and a sample bottle module. In a logging-while-drilling (LWD) configuration, the modules may be housed in a drill collar for performing various formation evaluation functions, such as pressure testing and fluid sampling, among others, and collecting representative samples of native formation fluid 50. As shown in FIG. 1, the fluid communication module 46 is positioned adjacent the sampling module 48; however the position of the fluid communication module 46, as well as other modules, may vary in other embodiments. Additional devices, such as pumps, gauges, sensors, monitors or other devices usable in downhole sampling and/or testing also may be provided. The additional devices may be incorporated into modules 46 or 48 or disposed within separate modules.

The downhole acquisition tool 12 may evaluate fluid properties of an obtained fluid 52. Generally, when the obtained fluid 52 is initially taken in by the downhole acquisition tool 12, the obtained fluid 52 may include some drilling mud 32, some mud filtrate 54 that has entered the formation 20, and the native formation fluid 50. The downhole acquisition tool 12 may store a sample of the native formation fluid 50 or perform a variety of in-situ testing to identify properties of the native formation fluid 50.

The fluid communication module 46 includes a probe 60, which may be positioned in a rib 62. The probe 60 includes one or more inlets for receiving the obtained fluid 52 and one or more flowlines (not shown) extending into the downhole tool 12 for passing fluids (e.g., the obtained fluid 52) through the tool. The probe 60 may include a radial focused probe or a probe with multiple inlets (e.g., a sampling probe and a guard probe) that may, for example, be used for focused sampling. In these embodiments, the probe 60 may be connected to the sampling flowline, as well as to guard flowlines. The probe 60 may be movable between extended and retracted positions for selectively engaging the wellbore wall 58 of the wellbore 14 and acquiring fluid samples from the geological formation 20. One or more setting pistons 64 may be provided to assist in positioning the fluid communication device against the wellbore wall 58.

Sensors may collect and transmit data 70 from the measurement of the fluid properties and the composition of the obtained fluid 52 to a control and data acquisition system 72 at surface 74, where the data 70 may be stored and processed in a data processing system 76 of the control and data acquisition system 72. The data processing system 76 may include a processor 78, memory 80, storage 82, and/or display 84. The memory 80 may include one or more tangible, non-transitory, machine readable media collectively storing one or more sets of instructions for operating the downhole acquisition tool 12 and estimating a mobility of the obtained fluid 52. The memory 80 may store algorithms associated with properties of the native formation fluid 50 (e.g., uncontaminated formation fluid) to compare to properties of the obtained fluid 52. The data processing system 76 may use the fluid property and composition information of the data 70 to estimate a mobility of the obtained fluid 52 in the guard line, the sample line, or both. These estimates may be used to adjust operation of the downhole tool or other equipment.

To process the data 70, the processor 78 may execute instructions stored in the memory 80 and/or storage 82. It may be appreciated that the processing may occur downhole in described embodiments. The instructions may cause the processor 78 to estimate fluid and compositional parameters of the native formation fluid 50 of the obtained fluid 52, and control flow rates of the sample and guard probes, and so forth. As such, the memory 80 and/or storage 82 of the data processing system 76 may be any suitable article of manufacture that can store the instructions. By way of example, the memory 80 and/or the storage 82 may be ROM memory, random-access memory (RAM), flash memory, an optical storage medium, or a hard disk drive. The display 84 may be any suitable electronic display that can display information (e.g., logs, tables, cross-plots, etc.) relating to properties of the well as measured by the downhole acquisition tool 12. It should be appreciated that, although the data processing system 76 is shown by way of example as being located at the surface 74, the data processing system 76 may be located in the downhole acquisition tool 12. In such embodiments, some of the data 70 may be processed and stored downhole (e.g., within the wellbore 14), while some of the data 70 may be sent to the surface 74 (e.g., in real time or near real time).

FIG. 2 depicts an example of a wireline downhole tool 100 that may employ the systems and methods of this disclosure. The downhole tool 100 is suspended in the wellbore 14 from the lower end of a multi-conductor cable 104 that is spooled on a winch at the surface 74. Like the downhole acquisition tool 12, the wireline downhole tool 100 may be conveyed on wired drill pipe, a combination of wired drill pipe and wireline, or any other suitable conveyance. The cable 104 is communicatively coupled to an electronics and processing system 106. The downhole tool 100 includes an elongated body 108 that houses modules 110, 112, 114, 122, and 124, that provide various functionalities including fluid sampling, sample bottle filling, fluid testing, operational control, and communication, among others. For example, the modules 110 and 112 may provide additional functionality such as fluid analysis, resistivity measurements, operational control, communications, coring, and/or imaging, among others.

As shown in FIG. 2, the module 114 is a fluid communication module 114 that has a selectively extendable probe 116 and backup pistons 118 that are arranged on opposite sides of the elongated body 108. The extendable probe 116 selectively seals off or isolates selected portions of the wall 58 of the wellbore 14 to fluidly couple to the adjacent geological formation 20 and/or to draw fluid samples from the geological formation 20. The probe 116 may include a single inlet or multiple inlets designed for guarded or focused sampling. The native formation fluid 50 may be expelled to the wellbore 14 through a port in the body 108 or the obtained fluid 52, including the native formation fluid 50, may be sent to one or more fluid sampling modules 122 and 124. The fluid sampling modules 122 and 124 may include sample chambers that store the obtained fluid 52. In the illustrated example, the electronics and processing system 106 and/or a downhole control system are configured to control the extendable probe assembly 116 and/or the drawing of a fluid sample from the geological formation 20 to enable analysis of the obtained fluid 52.

Figure 3:
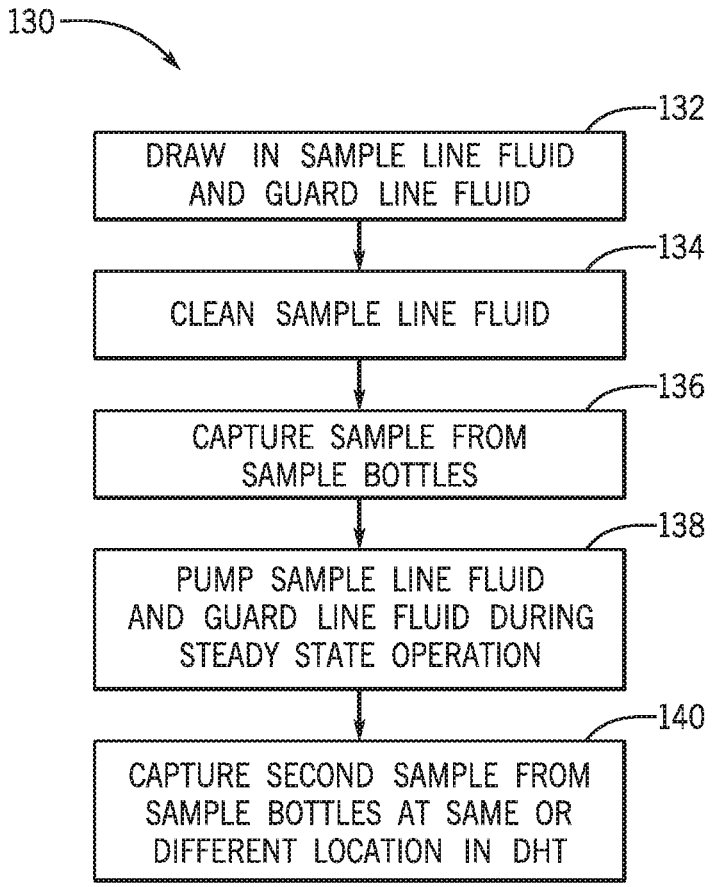
FIG. 3 illustrates a flowchart of a method for operating the downhole acquisition tool using a bottom pump module and a top pump module, in accordance with an embodiment.

Using these or any other suitable downhole acquisition tools, samples of formation fluids 50 may be obtained at the guard line, the sample line, or both. For example, as shown by a flowchart of FIG. 3, a method 130 for performing a steady state operation using the bottom pump module and the top pump module, in accordance with an embodiment. The method 130 includes drawing in (block 132) the sample line fluid and the guard line fluid. The method 130 includes cleaning (block 134) a sample of fluid (e.g., formation fluid) from the sample line. After the sample of fluid is cleaned to a suitable level, the method 130 includes capturing (block 136) a first sample of fluid in the sample bottles. The method 130 may include allowing an amount of time to pass before collecting a second sample of fluid. As such, the method 130 may include pumping (block 138) the sample line fluid and the guard line fluid during steady state operation of the downhole acquisition tool. In some embodiments, the method 130 may include continuously pumping the sample line fluid and the guard line fluid. The method 130 may then include capturing (block 140) a second sample using the sample bottles. The second sample may be captured at a different location from the first sample or at the same location as the first sample.

Figure 4:
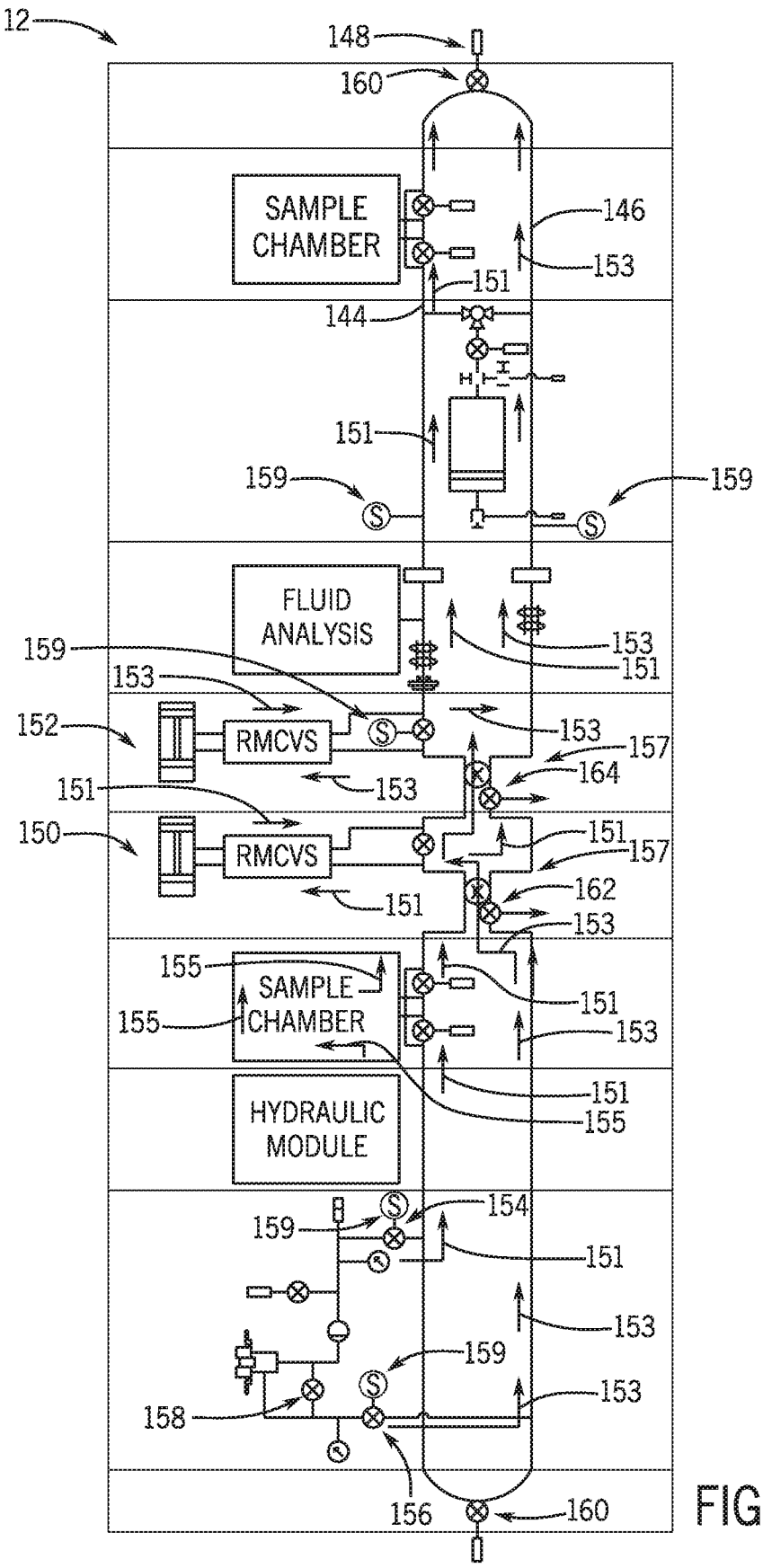
FIG. 4 is a schematic diagram of another example of a wireline wellsite system illustrating a sample line and a guard line used to draw in formation fluids in the wellbore, where a turnaround module is fluidly coupled to the sample line and the guard line, in accordance with an embodiment.

FIG. 4 is a schematic diagram of another example of a wireline wellsite system 142 illustrating a sample line 144 and a guard line 146 used to draw in formation fluids in the wellbore, where a turnaround module 148 is fluidly coupled to the sample line 144 and the guard line 146, in accordance with an embodiment. The wireline wellsite system 142 may flow fluid (e.g., through the sample line 144 and/or through the guard line 146) during steady state operation of the downhole acquisition tool 12. In the illustrated embodiment, the sample line fluid is drawn in through the sample line 144. The sample line 144 includes an isolation valve 154 to control the flow of the sample line fluid into the sample line 144. When the isolation valve 154 is open, the downhole acquisition tool 12 uses a bottom pump module 150 associated with the sample line 144 to draw in fluid with the bottom pump module 150. The flow path of the sample line fluid 144 is illustrated by arrows 151. A comingle valve 158 may be used when the isolation valve 154 is not being used.

The guard line fluid is drawn in through the guard line 146. The guard line 146 includes an isolation valve 156 to control the flow of the guard line fluid into the guard line 146. When the isolation valve 156 is open, the downhole acquisition tool 12 uses a top pump module 152 associated with the guard line 146 to draw in fluid with the top pump module 152. The flow path of the guard line fluid 146 is illustrated by arrows 153.

A flow of the downhole fluid and/or water generated during sample capture is shown by arrows 155. The sample line fluid and the guard line fluid follow the flow paths as shown by the sample line 144 and the guard line 146, respectively. As illustrated, the fluid may flow through a crossover portion 157. When the turnaround module 148 is open (e.g., in a first position), the sample line fluid and the guard line fluid may pass through the turnaround module. When the turnaround module 148 is open (e.g., when the valve 160 is opened and the port associate with the turnaround module 148 is open), the sample line fluid and the guard line fluid flow out of the downhole acquisition tool 12 and into a wellbore annulus. The turnaround module 148 includes a valve 160 that may be open when the turnaround module 148 is open. When the valve 160 is closed (e.g., in a second position), the turnaround module 148 may be used to turn the flow of the sample line 144 and/or the guard line 146 so that the sample line fluid, the guard line fluid, or both may be directed along a different flowline as explained in further detail below. One or more sensors 159 may be disposed along the flowlines 144, 146 or associated the flow control valves (e.g., the valve 160, the valve 184, the comingle valve 158, the isolation valve 154, 156, etc.) to output data that may be used to control the actuation of the valves and the fluid flow.

It may be appreciated that exit ports 162, 164 may be associated with the flowlines. In the illustrated embodiment, the exit ports 162, 164 are associated with the guard line 146 and the sample line 144, respectively. The exit ports 162, 164 may be selectively opened and closed to may be used to pump fluid (e.g., sample line fluid, guard line fluid) out of the flowlines. The exit ports 162, 164 may be used to direct the flow of the fluid in varying directions, depending on the configuration of hardware associated with the exit ports 162, 164. In some embodiments, one or more of the exit ports 162, 164 may utilize a check valve to control the fluid flow. The exit ports 162, 164 may be used when the both the bottom pump module 150 and the top pump module 152 are used to draw in the fluid, or when one of the bottom pump module 150 or the top pump module 152 are used as explained in further detail below.

Figure 5:
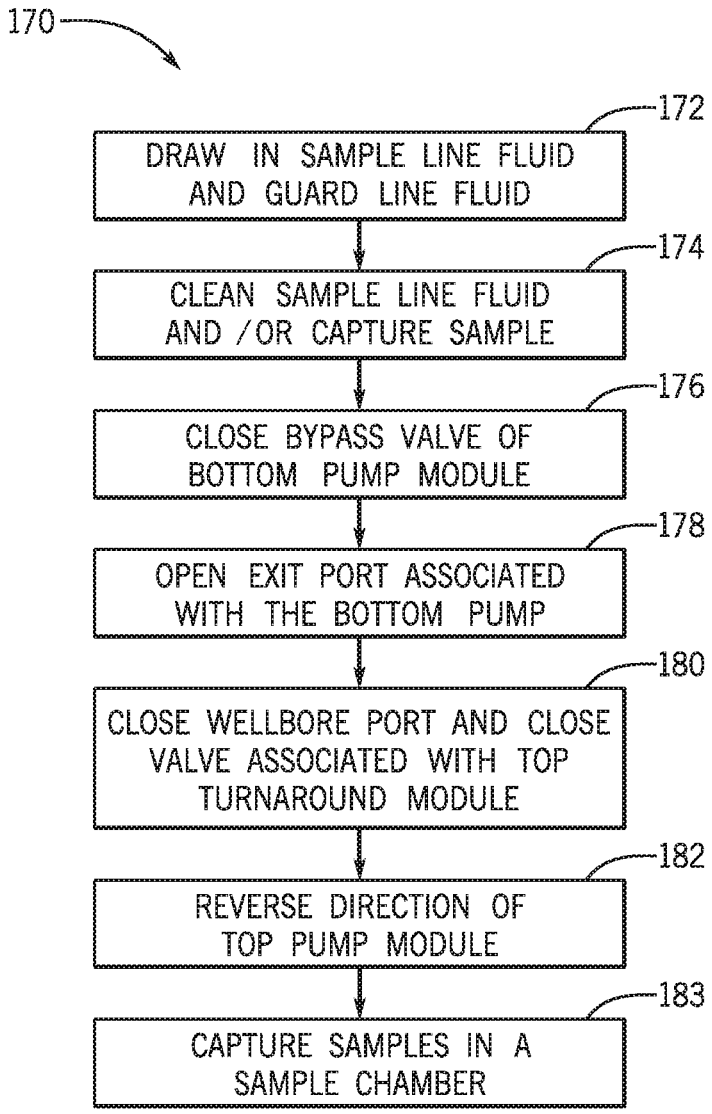
FIG. 5 illustrates a flowchart of method for operating the downhole acquisition tool using a top pump module, in accordance with an embodiment.

FIG. 5 illustrates a flowchart of a method 170 of the operating the downhole acquisition tool 12 using the top pump module 152, in accordance with an embodiment. The method 170 may be used when the bottom pump module 150 is unable to be used (e.g., to maintenance, equipment failure, etc.) or when it is not desirable to use the bottom pump module 150. The method 170 includes drawing in (block 172) the sample line fluid and the guard line fluid. While the fluid is drawn in, the exit ports 162, 164 may be closed and the fluid may flow out of the downhole acquisition tool 12 when the valve 160 is open. The method 170 includes cleaning the fluid or capturing a sample (block 174). The method 170 includes closing (block 176) a bypass valve 184 of the bottom pump module 150. The method 170 includes opening (block 178) the exit port 162 so that the fluid exits through the exit port. The method 170 includes closing (block 180) a wellbore port associated with the turnaround module 148 in the turnaround module (e.g. by closing a valve 160 associated with the turnaround module 148) to turn the fluid flow. The method 170 may include reversing (block 182) the pumping direction of the top pump module 152. The method includes capturing samples (block 183) in a sample chamber that is in fluid communication with the flowline 146. The sample may be captured with the pump that is connected to flowline 144 (e.g., when the fluid is pumped by the top pump module 152 through flowline 144 and is U-turned into flowline 146).

Figure 6:
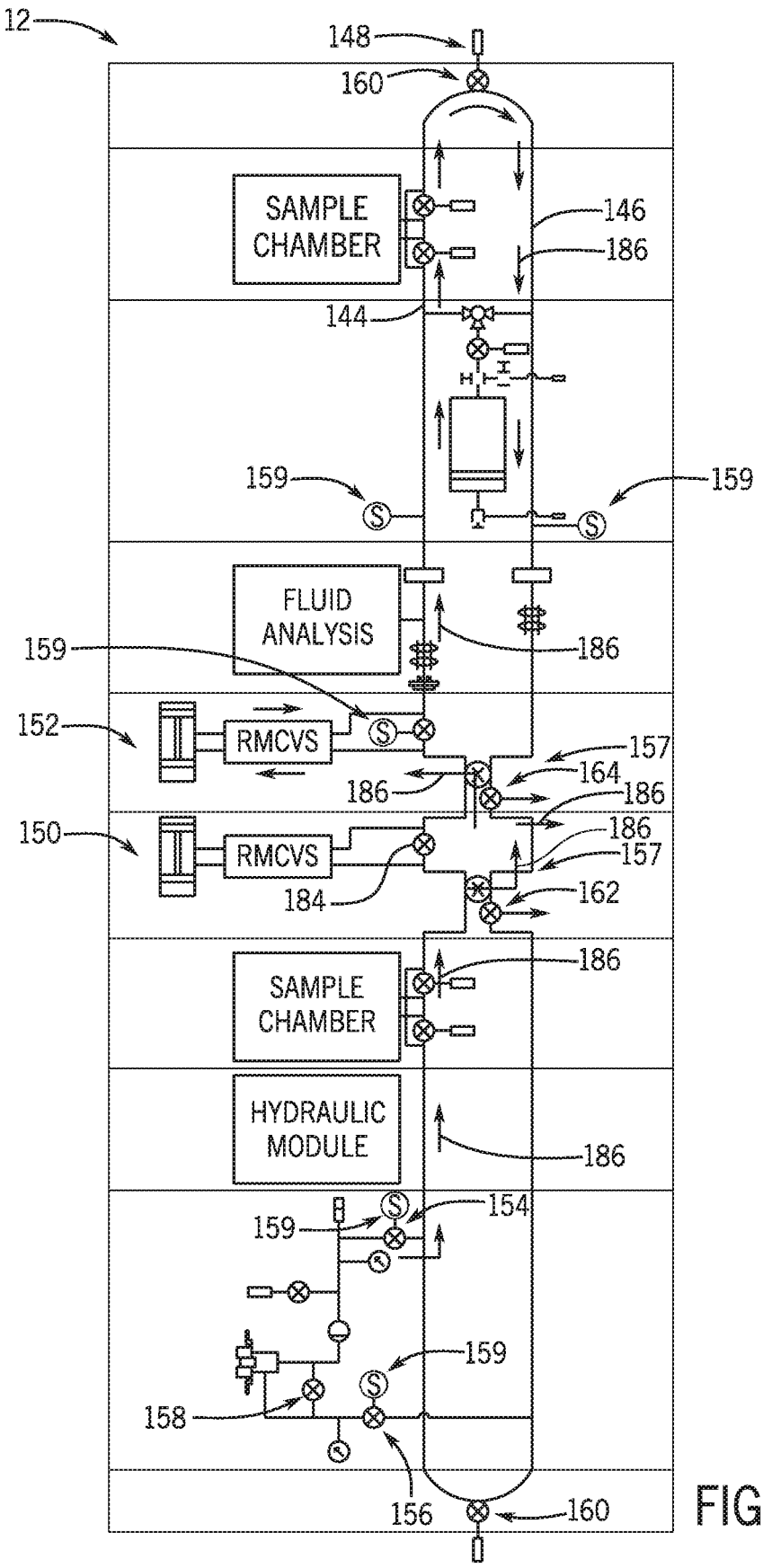
FIG. 6 is a schematic diagram of another example of a wireline wellsite system illustrating the sample line and the guard line used to draw in formation fluids in the wellbore, where the top pump module is used to direct fluid through the sample line and the guard line using a turnaround module, in accordance with an embodiment.

FIG. 6 is a schematic diagram of another example of a wireline wellsite system 142 illustrating the sample line 144 and the guard line 146 used to draw in formation fluids in the wellbore, where the top pump module 152 is used to direct fluid through the sample line 144 and the guard line 146 using a turnaround module 148, in accordance with an embodiment. In the illustrated embodiment, the sample line fluid is drawn in through the sample line 144. The sample line 144 uses the isolation valve 154 to control the flow of the sample line fluid into the sample line 144. In the illustrated embodiment, the downhole acquisition tool 12 bypasses the bottom pump module 150 associated with the sample line 144. The bypass valve 184 of the bottom pump module is closed and the exit port 162 is opened. The fluid follows the flow path indicated by the arrows 186 shown. As illustrated, the fluid is turned via the turnaround module 148 at the top of the downhole acquisition tool 12.

Figure 7:
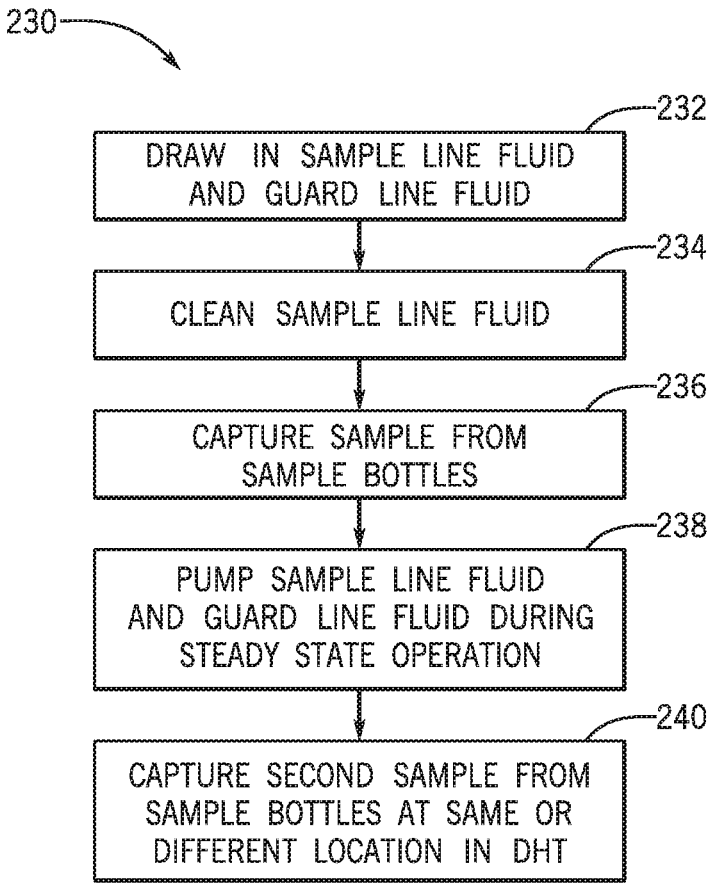
FIG. 7 illustrates a flowchart of a method for operating the downhole acquisition tool using the bottom pump module and the top pump module, in accordance with an embodiment.

FIG. 7 illustrates a flowchart of a method of operating the downhole acquisition tool using a bottom pump module and a top pump module, in accordance with an embodiment. A method 230 for performing a steady state operation using a bottom pump module and a top pump module, in accordance with an embodiment. The method 230 may be similar to the method 130 described above with reference to FIG. 3. In the method 230, the flow of the downhole fluid and/or water that the bottom pump module 150 generates during sample capture may be different compared to the method 130. The method 230 includes drawing in (block 232) the sample line fluid and the guard line fluid. The method 230 includes cleaning (block 234) a sample of fluid (e.g., formation fluid) from the sample line and the guard line. After the sample of fluid is cleaned to a suitable level, the method 230 includes capturing (block 236) a first sample of fluid in the sample bottles. The method 230 may include allowing an amount of time to pass before collecting a second sample of fluid. As such, the method 230 may include pumping (block 238) the sample line fluid and the guard line fluid during steady state operation of the downhole acquisition tool. The method 230 may then include capturing (block 240) a second sample from the sample bottles. The second sample may be captured at a different location from the first sample or at the same location as the first sample.

Figure 8:
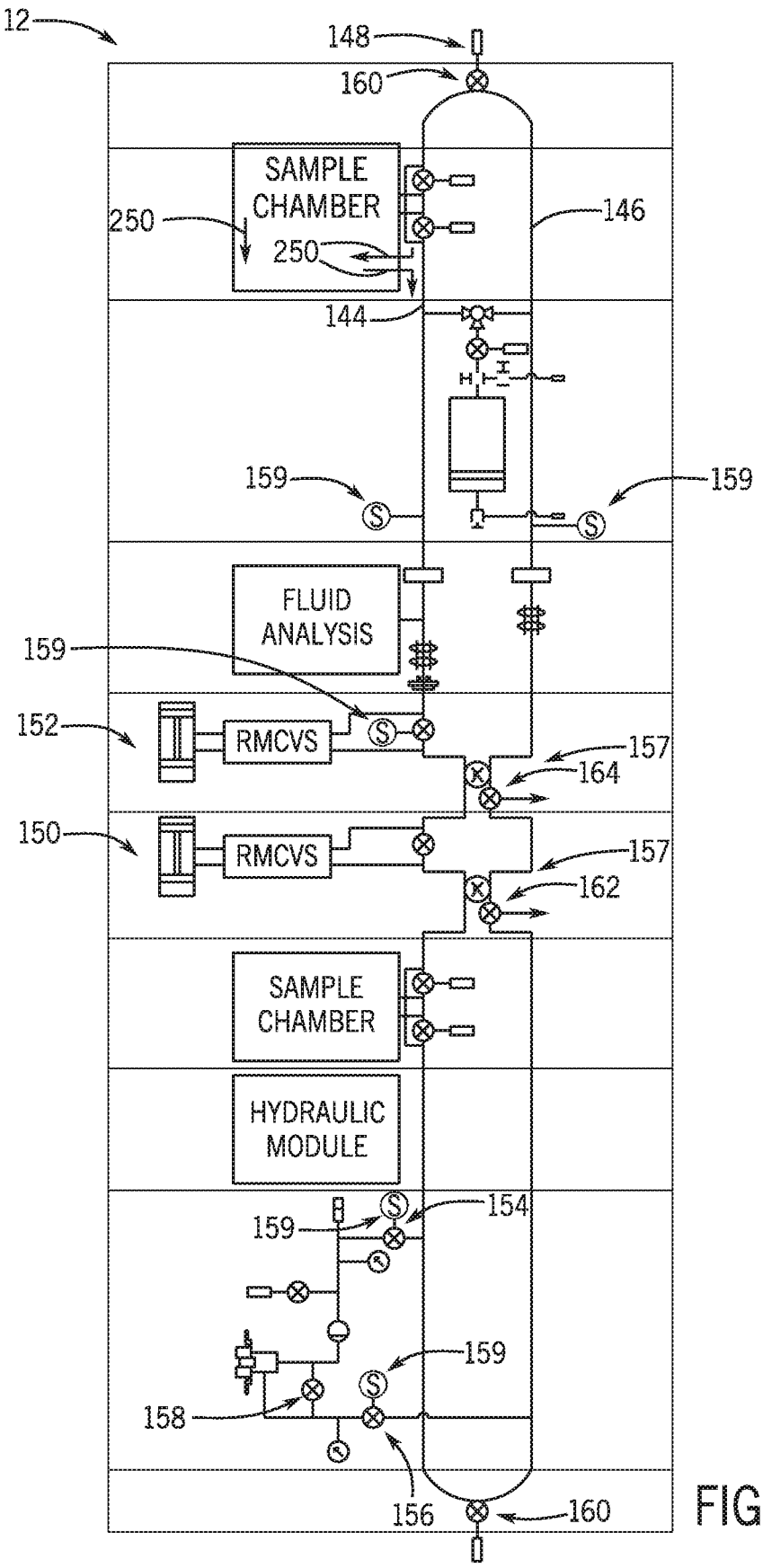
FIG. 8 is a schematic diagram of another example of a wireline wellsite system illustrating the sample line and the guard line used to draw in formation fluids in the wellbore, where the bottom pump module is used to direct fluid through the sample line and the guard line using the turnaround module, in accordance with an embodiment.

FIG. 8 is a schematic diagram of another example of a wireline wellsite system 142 illustrating the sample line 144 and the guard line 146 used to draw in formation fluids in the wellbore, where the turnaround module 148 is fluidly coupled to the sample line 144 and the guard line 146, in accordance with an embodiment. As described above, the flow of the downhole fluid and/or water that the bottom pump module 150 generates during sample capture may be different compared to the embodiment illustrated in FIG. 4. The flow of the downhole fluid and/or water generated during sample capture is shown by arrows 250.

As described above, the sample line fluid is drawn in through the sample line 144. The sample line 144 includes an isolation valve 154 to control the flow of the sample line fluid into the sample line 144. In the illustrated embodiment, the downhole acquisition tool 12 uses the bottom pump module 150 associated with the sample line 144 to draw in fluid with the bottom pump module 150. A comingle valve 158 may be used when the isolation valve 154 is not being used (e.g., when the isolation valve 154 is closed). The guard line fluid is drawn in through the guard line 146. The guard line 146 includes an isolation valve 156 to control the flow of the guard line fluid into the guard line 146. When the isolation valve 156 is open, the downhole acquisition tool 12 uses the top pump module 152 associated with the guard line 146 to draw in fluid with the top pump module 152. As described above, the one or more sensors 159 may be disposed along the flowlines 144, 146 or associated the flow control valves (e.g., the valve 160, the valve 184, the comingle valve 158, the isolation valve 154, 156, etc.) to output data that may be used to control the actuation of the valves and the fluid flow.

It may be appreciated that both the bottom pump module 150 and the top pump module 152 are used to draw in the fluid, or when one of the bottom pump module 150 or the top pump module 152 are used as explained in further detail below.

Figure 9:
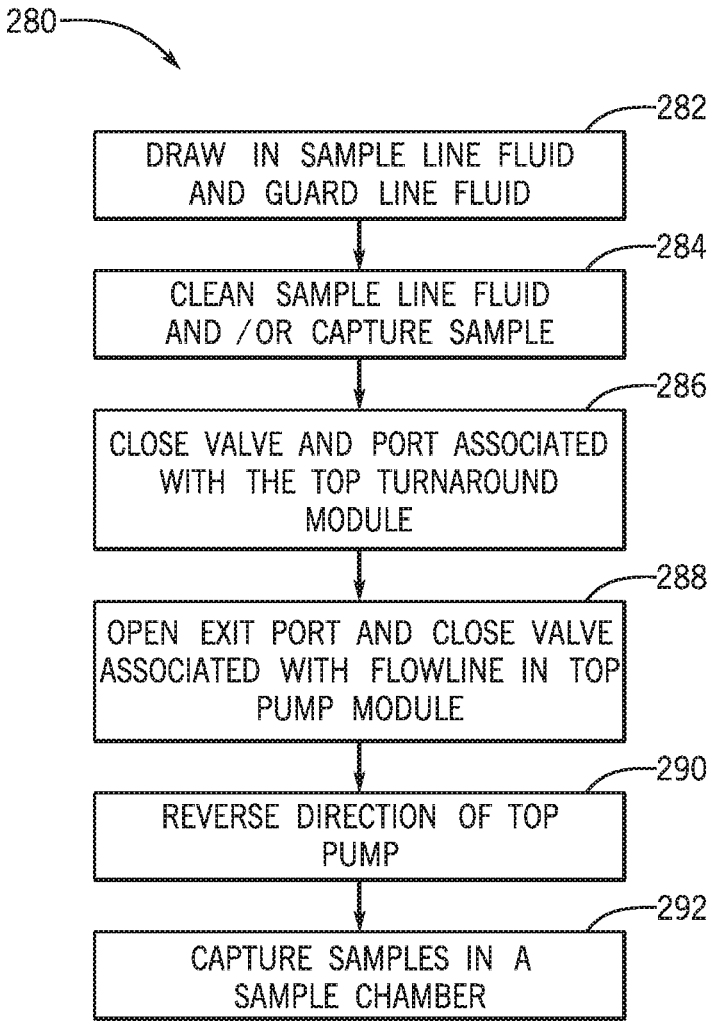
FIG. 9 illustrates a flowchart of a method for operating the downhole acquisition tool using the bottom pump module, in accordance with an embodiment

FIG. 9 illustrates a flowchart of a method 280 of operating the downhole acquisition tool 12 using the bottom pump module 150, in accordance with an embodiment. The method 280 may be used when the top pump module 152 is not able to be used or it is not desired to use the top pump module. The method 280 includes drawing in (block 282) the sample line fluid and the guard line fluid. The method 280 includes cleaning sample line fluid and/or capture the sample (block 284). The method 280 includes closing (block 286) the valve 160 and the port associated with the top turnaround module 148. The method 280 includes opening (block 288) the exit port 164 and opening the bypass valve associated with flowline in the top pump module 152. The method 280 may include reversing (block 290) the direction of the bottom pump module 150. The method 280 includes capturing samples (block 292) in a sample chamber that is in fluid communication with the flowline 144. The sample may be captured with the pump that is connected to flowline 146 (e.g., when the fluid pumped by the bottom pump module 150 through flowline 146 and is U-turned into flowline 144).

Figure 10:
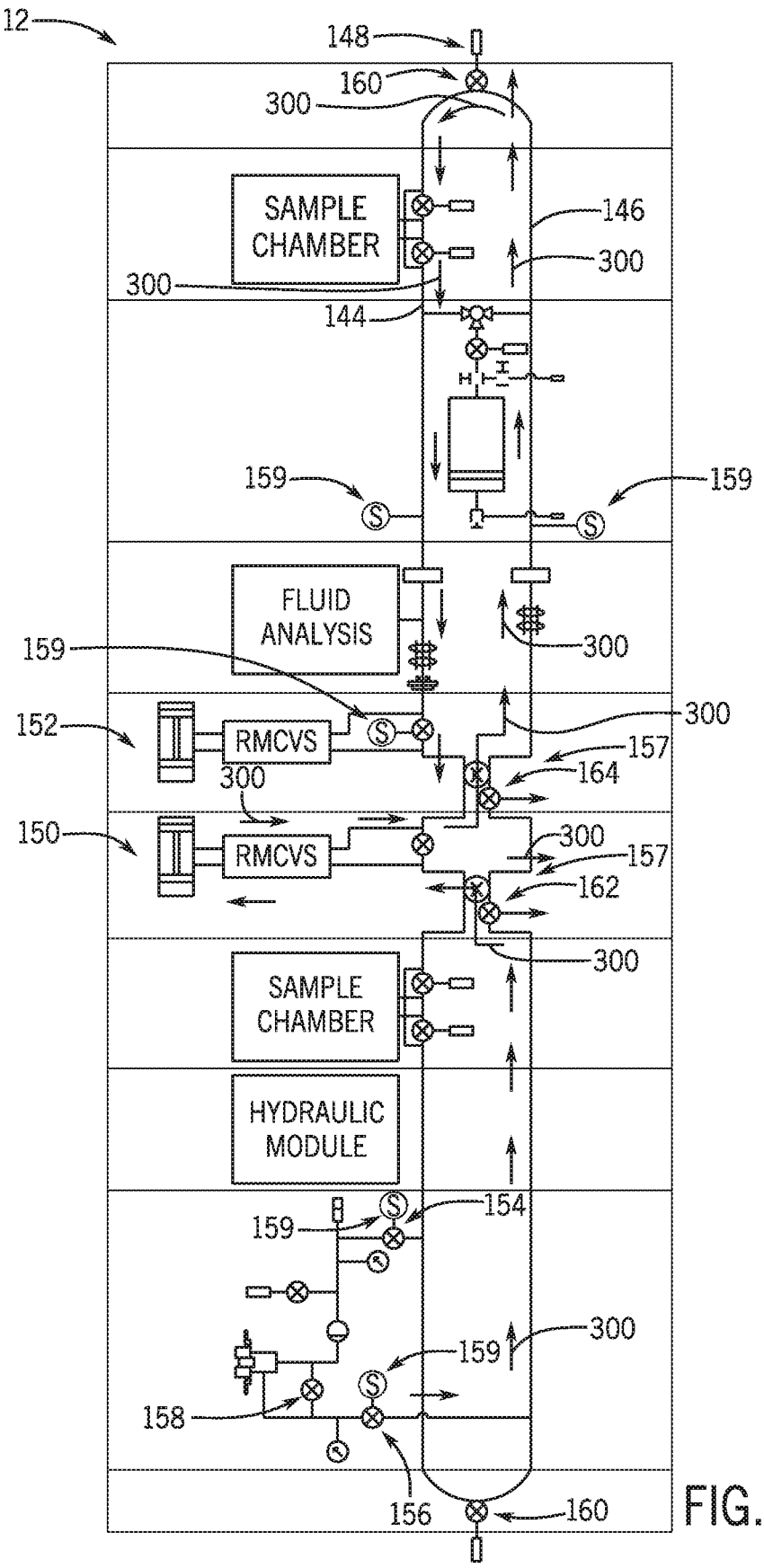
FIG. 10 is a schematic diagram of another example of a wireline wellsite system illustrating the sample line and the guard line used to draw in formation fluids in the wellbore, where the bottom pump module is used to direct fluid through the sample line and the guard line using the turnaround module, in accordance with an embodiment.

FIG. 10 is a schematic diagram of another example of a wireline wellsite system 142 illustrating the sample line 144 and the guard line 146 used to draw in formation fluids in the wellbore, where the bottom pump module 150 is used to direct fluid through the sample line 144 and the guard line 146 using the turnaround modules 148, in accordance with an embodiment.

In the illustrated embodiment, the sample line fluid is drawn in through the sample line 144. The guard line 146 uses the isolation valve 158 to control the flow of the guard line fluid into the guard line 146. As described above, the fluid may flow through the crossover portion 157. In the illustrated embodiment, the downhole acquisition tool 12 bypasses the top pump module 152 associated with the guard line 146. The turnaround modules 148 are opened and the exit port 162 is closed. The flowline to top pump module 152 is closed. The direction of the top pump module 152 is reversed. The guard line fluid follows the flow path indicated by the arrows 300 shown.

Figure 11:
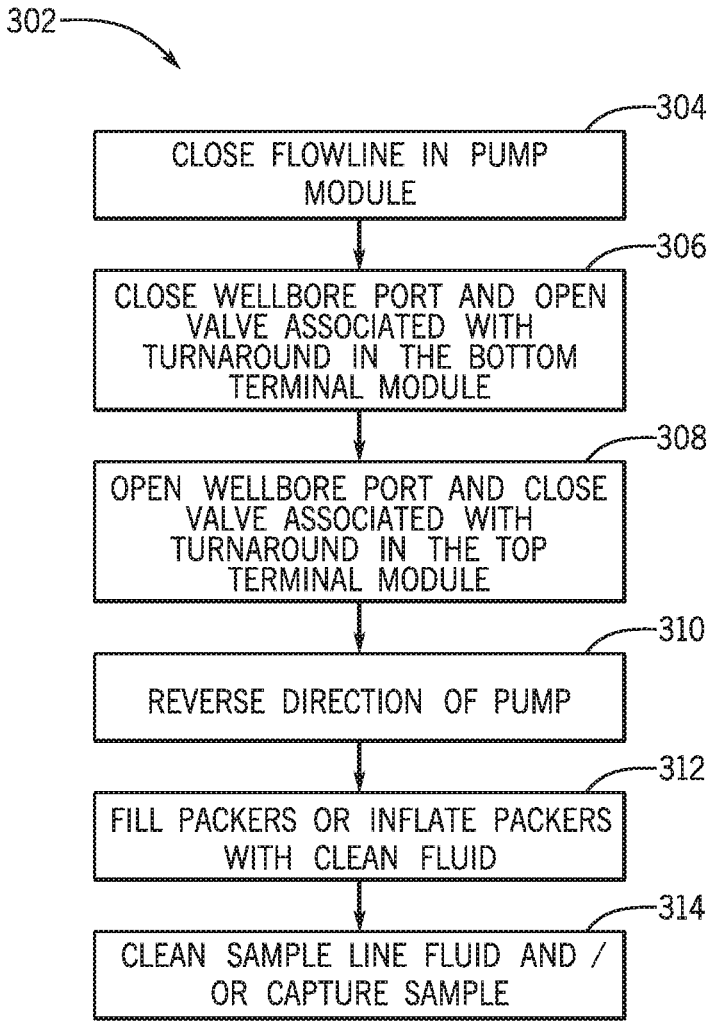
FIG. 11 illustrates a flowchart of a method for using the single pump module and a plurality of packers used to draw in formation fluids in the wellbore, in accordance with an embodiment.

FIG. 11 illustrates a flowchart of a method 302 of using a single pump module and a plurality of packers used to draw in formation fluids in the wellbore, in accordance with an embodiment. The method 302 includes closing (block 304) a flowline in pump module. The method 302 includes closing (block 306) the wellbore port and opening the turnaround module in the bottom terminal module. The method 302 includes opening (block 308) the wellbore port and closing the turnaround in the top terminal module. When the packers are filled with fluid from a volume chamber 326, the valve 160 associated with the turnaround module 148 may be closed. When the packers are filled with fluid from the borehole, the valve 160 associated with the turnaround module 148 may be opened. It may be appreciated that the valves associated with the sample chamber are closed when the packers are filled. The method 302 includes reversing (block 310) the direction of the pump module. The method 302 includes filling (block 312) the packers or inflating the packers with clean fluid. The method 302 includes cleaning (block 314) the sample line fluid and/or capturing the sample.

Figure 12:
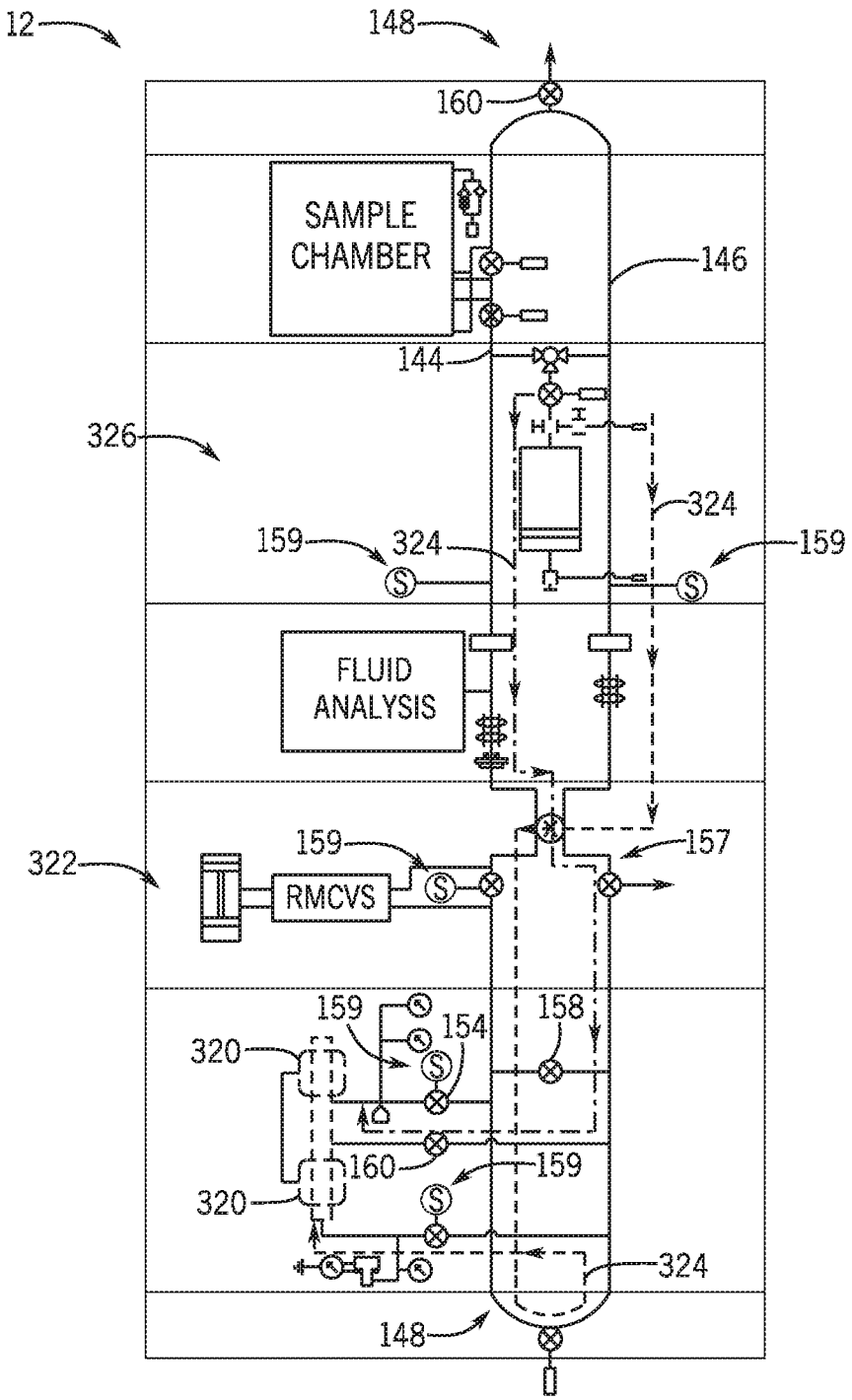
FIG. 12 is a schematic diagram of another example of a wireline wellsite system illustrating the plurality of packers used to draw in formation fluids in the wellbore through the sample line and the guard line, where the single pump module is used to direct fluid through the sample line and the guard line using the turnaround modules, in accordance with an embodiment.

FIG. 12 is a schematic diagram of another example of a wireline wellsite system illustrating a plurality of packers 320 used to draw in formation fluids in the wellbore through the sample line 144 and the guard line 146, where a single pump module 322 is used to direct fluid through the sample line 144 and the guard line 146 using the turnaround modules 148, in accordance with an embodiment. Instead of opening the exit port and closing the turnaround module 148 in the top terminal module, the inflation fluid may be drawn from the sample chamber 326. The inflation of the packers 320 may be performed with the single pump module 322 as shown by arrows 324. As described above, the one or more sensors 159 may be disposed along the flowlines 144, 146 or associated the flow control valves (e.g., the valve 160, the valve 184, the comingle valve 158, the isolation valve 154, 156, etc.) to output data that may be used to control the actuation of the valves and the fluid flow.

Figure 13:
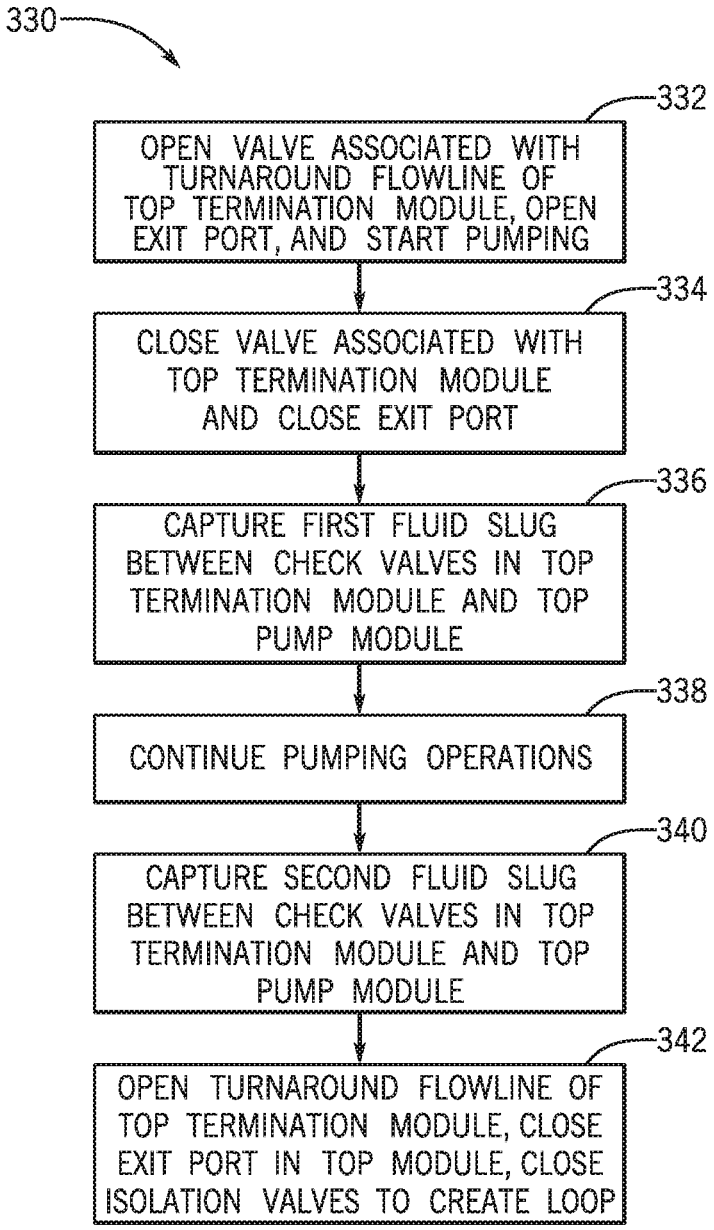
FIG. 13 illustrates a flowchart of a method for collecting a plurality of fluid slugs within the sample line and the guard line, in accordance with an embodiment.

FIG. 13 illustrates a flowchart of a method 330 for collecting a plurality of fluid slugs within the sample line 144 and the guard line 146, in accordance with an embodiment. The method 330 includes opening (block 332) the valve 160 associated with the turnaround flowline of the top termination module, opening the exit port, and starting to pump the fluid so that the fluid is pumped out of the tool 12. The method 330 includes closing (block 334) the valve 160 associated with the turnaround flowline of the top termination module and closing the exit port to turn the fluid. The method 330 includes capturing (block 336) a first fluid slug in the flowline 146 between the check valves in the top termination module and the top pump module 152. The method 330 includes continuing (block 338) the pumping operations using the top pump module 152, flowing fluid through the flowline 144, and out of the turnaround module 148 through the open valve 160. The method 330 includes capturing (block 340) a second fluid slug in flowline 144 between the check valves in the top termination module and the top pump module 152. The method 330 includes opening (block 342) the turnaround flowline of the top termination module, closing the exit port in the top module, and closing the isolation valves to create a loop across the modules of the downhole acquisition tool.

Figure 14:
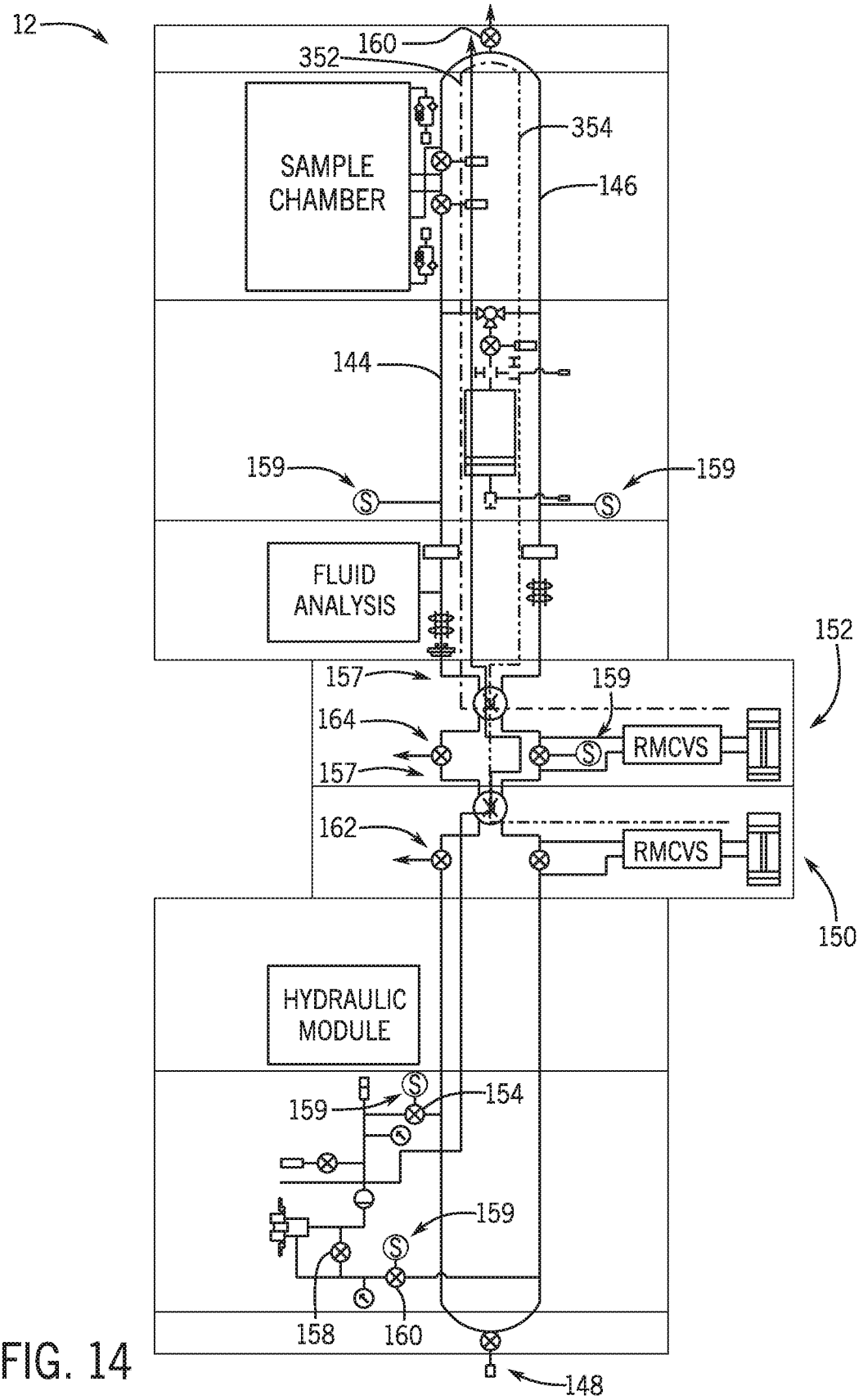
FIG. 14 is a schematic diagram of another example of a wireline wellsite system illustrating the plurality of fluid slugs within the sample line and the guard line, in accordance with an embodiment.

FIG. 14 is a schematic diagram of another example of a wireline wellsite system 142 illustrating the plurality of fluid slugs 350 within the sample line 144 and the guard line 146, in accordance with an embodiment. A first fluid slug 354 is formed in the flowline 146 between the check valves in the top termination module and the lower pump module 150 as shown. A second fluid slug 352 is formed between the top termination module (e.g., a check valve associated with the top termination module) and the top pump module 152, as shown. As shown, the downhole fluid originates from the sample inlet. Either of the pump modules or both may be used to circulate one or both of the fluid slugs 352, 354 between the fluid analyzers. Fluid analysis of the fluid slugs 352, 354 may be used to measure fluid properties of the slugs.

Figure 15:
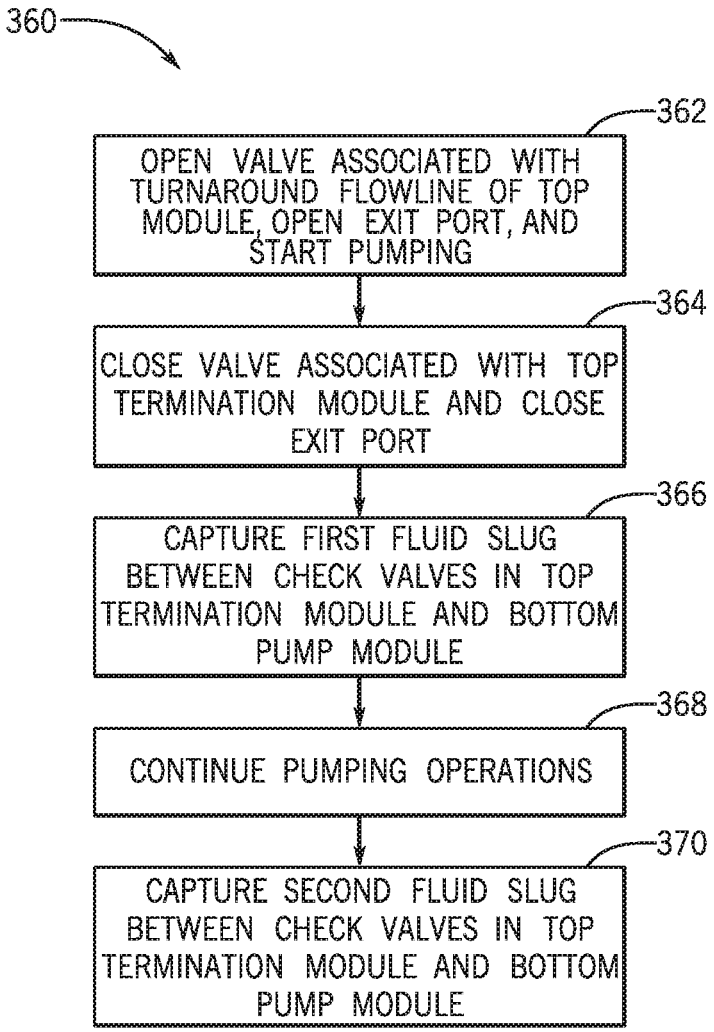
FIG. 15 illustrates a flowchart of a method for collecting a plurality of larger fluid slugs within the sample line and the guard line, in accordance with an embodiment.

FIG. 15 illustrates a flowchart of a method 360 for collecting a plurality of larger fluid slugs within the sample line 144 and the guard line 146, in accordance with an embodiment. The method 360 includes opening (block 362) the valve 160 associated with the turnaround flowline of the top termination module, opening the exit port, and starting to pump the fluid so that the fluid is pumped out of the tool 12. The method 360 includes closing (block 364) the valve 160 associated with the turnaround flowline of the top termination module and closing the exit port to turn the fluid. The method 360 includes capturing (block 366) a first fluid slug between the top termination module and the bottom termination module (e.g., between check valves associated with the top termination module and the bottom termination module). The method 360 includes continuing (block 368) pumping operations using the top pump module 152. The method 360 includes capturing (block 370) a second fluid slug between check valves in the top termination module and the bottom pump module.

Figure 16:
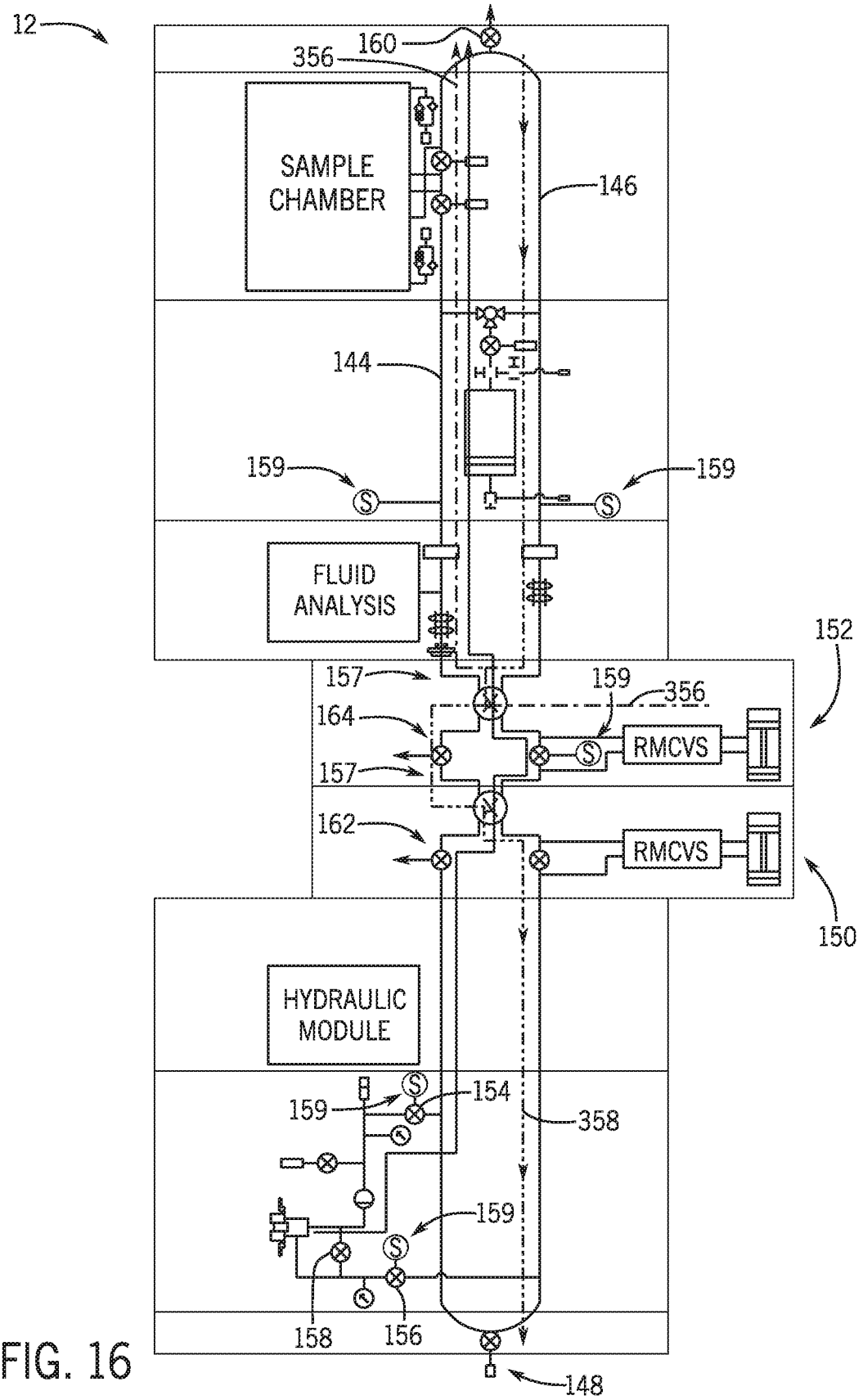
FIG. 16 is a schematic diagram of another example of a wireline wellsite system illustrating the plurality of larger fluid slugs within the sample line and the guard line, in accordance with an embodiment.

FIG. 16 is a schematic diagram of another example of a wireline wellsite system 142 illustrating the plurality of larger fluid slugs 350 within the sample line 144 and the guard line 146, in accordance with an embodiment. A first fluid slug 356 is formed between the check valves in the top termination module and the top pump module 152 as shown. A second fluid slug 358 is formed between the check valves in the top termination module and the bottom pump module as shown. Arrows illustrate the fluid flow from the sample flowline and may be used to clean the flowline loop 356. Arrows show the flow path of the second fluid slug 358. Either of the pump modules or both may be used to circulate one or both of the fluid slugs 352, 354 between the fluid analyzers. Fluid analysis of the fluid slugs 356, 358 may be used to measure fluid properties of the slugs.

Figure 17:
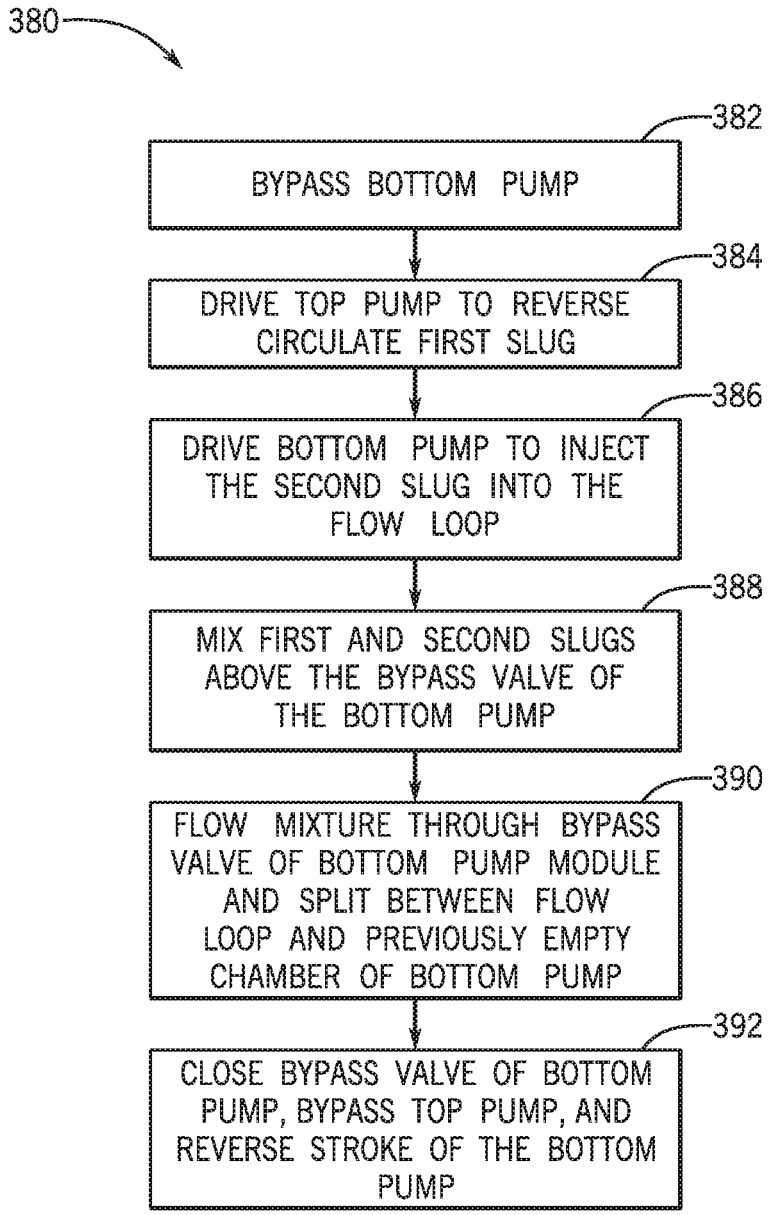
FIG. 17 illustrates a flowchart of a method for mixing a plurality of fluid slugs within the sample line and the guard line, in accordance with an embodiment.

FIG. 17 illustrates a flowchart of a method 380 for mixing a plurality of fluid slugs within the sample line and the guard line, in accordance with an embodiment. The method 380 includes bypassing (block 382) the bottom pump module 150 that contains the same fluid as the second slug. The method 380 include driving (block 384) the top pump module 152 to reverse circulate the first fluid slug. The method 380 includes driving (block 386) the bottom pump module 150 to inject the second slug into the flow loop. It may be appreciated that the pump modules may be run at different speeds relative to one another to facilitate mixing of the fluids. The method 380 includes mixing (block 388) the first and second fluid slugs above the bypass valve of the bottom pump module 150. The method 380 includes flowing (block 390) the mixture through the bypass valve of the bottom pump module 150 and splitting the flow between the flow loop and the previously empty chamber of the bottom pump module 150. The method 380 includes closing (block 392) the bypass valve of the bottom pump module 150, bypassing the top pump module 152, and reversing the stroke of the bottom pump module. Mixing the fluid slugs may be useful to analyze the mixed fluids by directing the mixed fluid slug to a fluid analyzer, study fluid compatibility, perform chemical experiments, and so forth.

Figure 18:
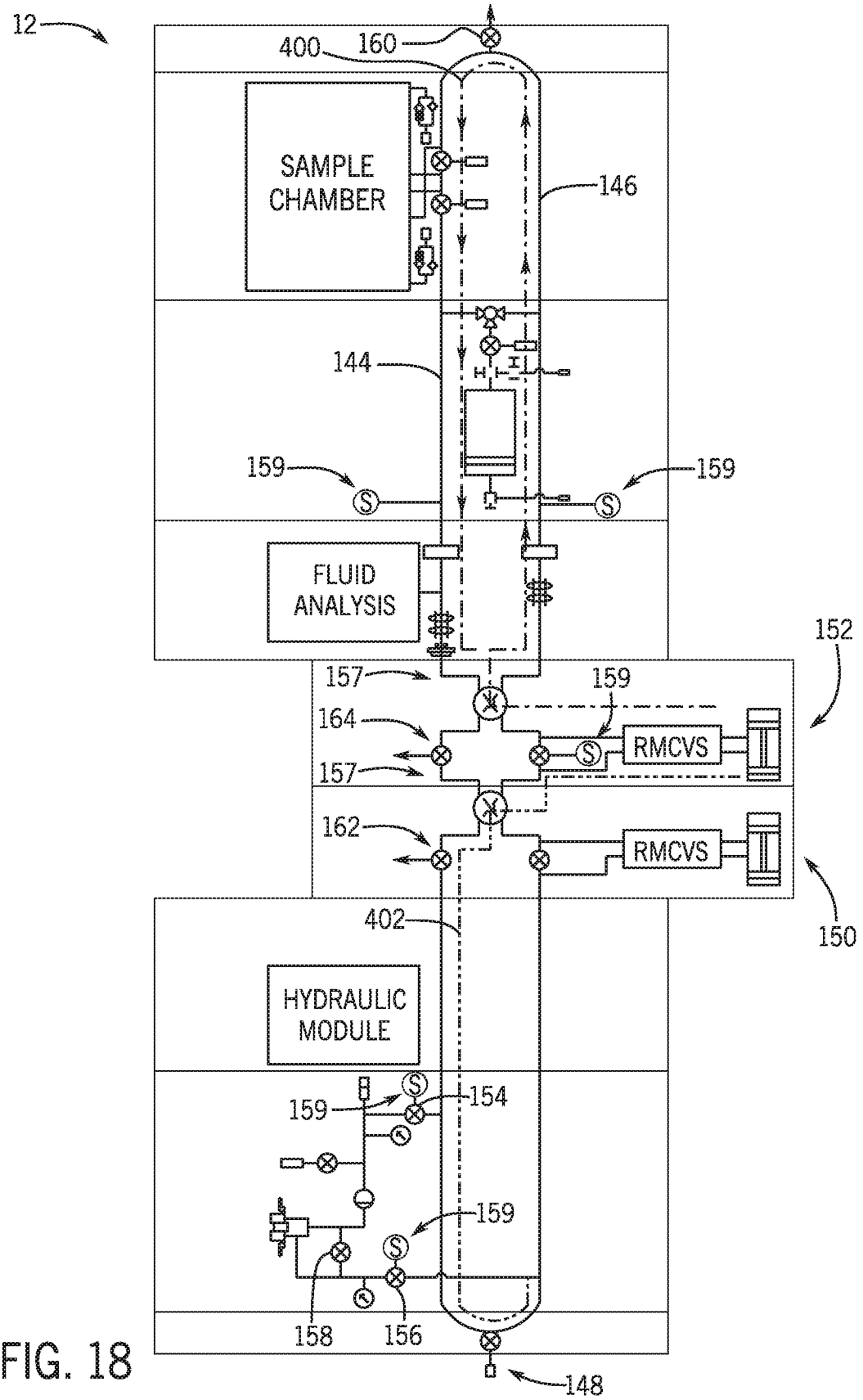
FIG. 18 is a schematic diagram of another example of a wireline wellsite system illustrating the mixed plurality of fluid slugs within the sample line and the guard line, in accordance with an embodiment.

FIG. 18 is a schematic diagram of another example of a wireline wellsite system 142 illustrating the mixed plurality of fluid slugs 400, 402 within the sample line 144 and the guard line 146, in accordance with an embodiment. The first fluid slug 400 is circulated by the top pump module 150 and the second fluid slug 402 is driven to inject the second slug into the flow loop as shown by the arrows.

Figure 19:
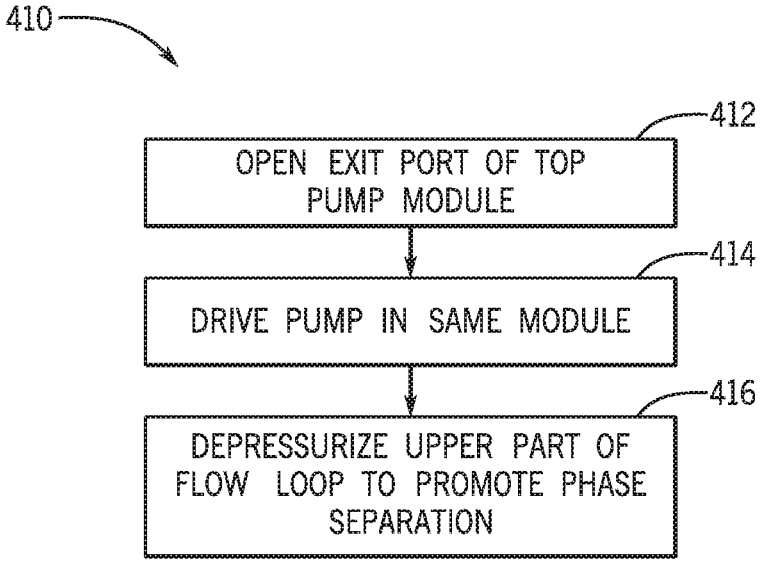
FIG. 19 illustrates a flowchart of a method for performing a phase separation within the sample line and the guard line, in accordance with an embodiment.

FIG. 19 illustrates a flowchart of a method 410 for performing a phase separation within the sample line 144 and the guard line 146, in accordance with an embodiment. The method 410 includes opening (block 412) the exit port of the top pump module 152. The method 410 includes driving (block 414) the pump in the same module. The method 410 includes depressurizing (block 416) the upper part of the flow loop to promote phase separation of the fluid. It may be appreciated either of the pump modules may be used to circulated the separated phases to fluid analyzers. When the method 410 is combined with the control, other benefits may be seen, such as determining the phase border at the temperature of the flowline fluid.

It may be appreciated that any of the above referenced systems and methods for operating the wireline well site system 142, drawing in fluids through the sample line 144 and/or the guard line 146 may be accomplished in part by using a plurality of flow routing plug modules 450. Each of the flow routing plug modules 450 may include one or more flow routing plugs 452 and a motor-driven valve 454. The flow routing modules 450 may enable the sample line 144 and the guard line 146 to be connected in any number of different ways, as explained in detail below with reference to FIGS. 20-27. It may be appreciated that the flow routing modules 450 may be used when the downhole acquisition tool 12 uses the turnaround module 148 or when the downhole acquisition tool 12 remains unconnected near the top of the tool 12 (e.g., near the surface). The flow routing modules 450 reduce the amount of hardware and different hardware versions necessary to connect the sample line 144 and the guard line 146 to each other, or to the borehole, or to block the flow through the sample line 144 or the guard line 146.

The flow routing plugs 452 may be removably coupled to a sample line 144, the guard line 146, or both. The flow routing modules 450 enable the connection between the sample line 144 and the guard line 146 to changed relatively quickly. For example, the flow routing plugs 452 may be uncoupled from the flowlines (e.g., the sample line 144, the guard line 146, or both) at the surface. Once the initial flow routing plug 452 is uncoupled from the flowline, another flow routing plug 452 can be removably coupled using a suitable fastener (e.g., a bolt assembly).

In the illustrated embodiments, the flow routing modules 450 include three flow routing plugs 452 and the motor-driven valve 454. A first and a second plug of the plurality of the flow routing plugs 452 may be coupled to the sample line 144 and the guard line 146, respectively. A third plug of the plurality of flow routing plugs 452 may be disposed between the sample line 144 and the guard line 146. The single motor-driven valve 454 may be used control the flow through the valve along a line disposed between the sample line 144 and the guard line 146. In other words, when the motor-driven valve 454 is opened, fluid is allowed to flow through the valve 454. When the motor-driven valve 454 is closed, fluid is not allowed to flow through the valve 454. Each of the flow routing plugs 452 may utilize a plurality of fluidic connections 456 to route the fluid.

In some embodiments, the flow routing plugs 452 may use as many as four fluidic connections 456 to direct the fluid flow. Various embodiments of the flow routing modules 450 may be further understood with reference to FIGS. 20-27.

Figure 20:
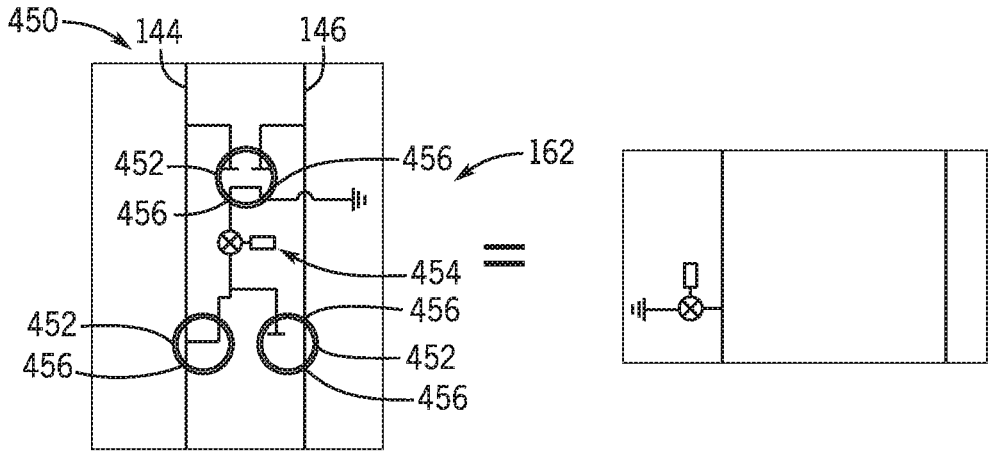
FIG. 20 illustrates a schematic diagram of an embodiment of the flow routing module within the wireline wellsite system.

FIG. 20 illustrates a schematic diagram of an embodiment of the flow routing module 450 within the wireline wellsite system 142. In the illustrated embodiment, the top most flow routing plug 452 utilizes two fluidic connections 456. The fluidic connections 456 are oriented to turn the fluid from the motor-driven valve 454 through the flow routing plug 452 such that the fluid can exit the flow routing plug 452 via the sample line exit port 162. The flow routing plug 452 disposed on the sample line 144 utilizes three fluidic connections 456. The fluidic connections 456 enable the sample line fluid to enter the motor-driven valve 454 to pass through to the exit port 162 and, in addition, enable the sample line fluid to flow through the sample line 144, thereby bypassing the motor-driven valve 454. The flow routing plug 452 disposed on the guard line 146 utilizes two fluidic connections 456. The fluidic connections 456 enable the guard line fluid to flow through the guard line 146, thereby bypassing the motor-driven valve 454. When the motor-driven valve 454 is open, the routing module 450 acts as an exit port for the sample line 144. When the motor-driven valve 454 is closed, the module 450 allows continuous flow of the sample line 144 flow and guard line 146.

Figure 21:
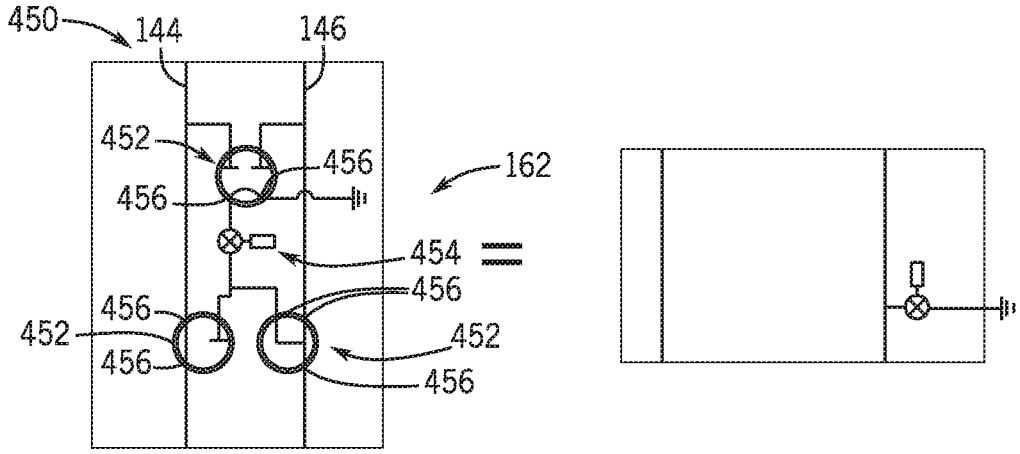
FIG. 21 illustrates a schematic diagram of an embodiment of the flow routing module within the wireline wellsite system.

FIG. 21 illustrates a schematic diagram of an embodiment of the flow routing module 450 within the wireline wellsite system 142. In the illustrated embodiment, the top most flow routing plug 452 utilizes two fluidic connections 456. The fluidic connections 456 are oriented to turn the fluid from the motor-driven valve 454 through the flow routing plug 452 such that the fluid can exit the flow routing plug 452 via the exit port 162. The flow routing plug 452 disposed on the sample line 144 utilizes two fluidic connections 456. The fluidic connections 456 enable the sample line fluid to flow through the sample line 144, thereby bypassing the motor-driven valve 454. The flow routing plug 452 disposed on the guard line 146 utilizes three fluidic connections 456. The fluidic connections 456 enable the guard line fluid to flow through the guard line 146, thereby bypassing the motor-driven valve 454. The fluidic connections 456 enable the guard line fluid to flow through the motor-driven valve 454 to pass through to the exit port 162. When the motor-driven valve 454 is open, the routing module 450 acts as an exit port for the guard line 146. When the motor-driven valve 454 is closed, the module 450 allows continuous flow of the sample line 144 flow and guard line 146.

Figure 22:
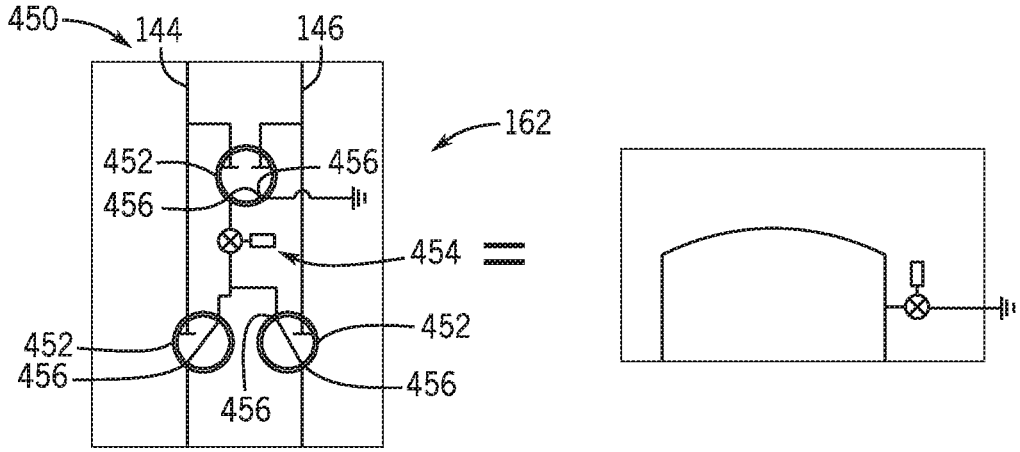
FIG. 22 illustrates a schematic diagram of an embodiment of the flow routing module within the wireline wellsite system.

FIG. 22 illustrates a schematic diagram of an embodiment of the flow routing module 450 within the wireline wellsite system 142. In the illustrated embodiment, the top most flow routing plug 452 utilizes two fluidic connections 456. The fluidic connections 456 are oriented to turn the fluid from the motor-driven valve 454 through the flow routing plug 452 such that the fluid exit via the exit port 162. The flow routing plug 452 disposed on the sample line 144 utilizes two fluidic connections 456. The fluidic connections 456 enable the sample line fluid to flow from the sample line 144 to the motor-driven valve 454. The flow routing plug 452 disposed on the guard line 146 utilizes two fluidic connections 456. The fluidic connections 456 enable the guard line fluid to flow from the guard line 146 to the motor-driven valve 454. As such, the fluid flow from both the sample line 144 and the guard line 146 flow through the motor-driven valve 454. When the motor-driven valve 454 is closed, the module 450 acts as a turnaround (e.g., U-turn) connecting the fluid flow of the sample and guard lines 144, 146. When the motor-driven valve 454 is open, the module 450 acts as a common exit for sample line 144 and guard line 146.

Figure 23:
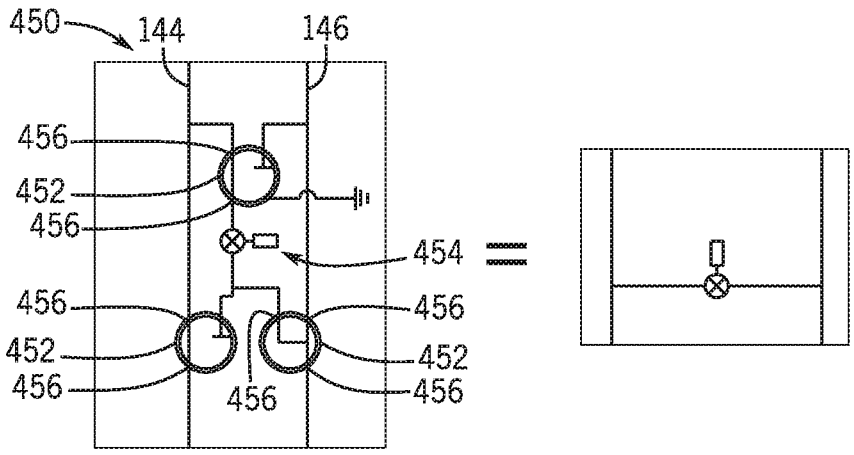
FIG. 23 illustrates a schematic diagram of an embodiment of the flow routing module within the wireline wellsite system.

FIG. 23 illustrates a schematic diagram of an embodiment of the flow routing module 450 within the wireline wellsite system 142. In the illustrated embodiment, the top most flow routing plug 452 utilizes two fluidic connections 456. The fluidic connections 456 are oriented to pass the fluid through the flow routing plug 452 such that the fluid flows from the motor-driven valve 454 to the sample line 144. The flow routing plug 452 disposed on the sample line 144 utilizes two fluidic connections 456. The fluidic connections 456 enable the sample line fluid to flow through the sample line 144, thereby bypassing the motor-driven valve 454. The flow routing plug 452 disposed on the guard line 146 utilizes three fluidic connections 456. The fluidic connections 456 enable the guard line fluid to flow from the guard line 146 to the motor-driven valve 454 and also enable the guard line fluid to flow through the guard line 146, thereby bypassing the motor-driven valve 454. As such, the module 450 connects the sample line 144 and to the guard line 146. This allows, for example, fluid flow from both the sample line 144 and the guard line 146 flow through the motor-driven valve 454 to mix with the sample line fluid so that a comingled fluid can be formed.

Figure 24:
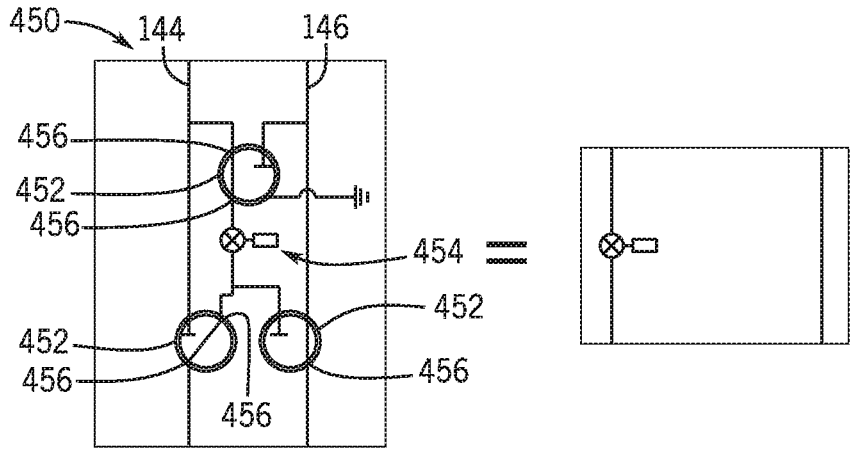
FIG. 24 illustrates a schematic diagram of an embodiment of the flow routing module within the wireline wellsite system.

FIG. 24 illustrates a schematic diagram of an embodiment of the flow routing module 450 within the wireline wellsite system 142. In the illustrated embodiment, the top most flow routing plug 452 utilizes two fluidic connections 456. The fluidic connections 456 are oriented to flow the fluid from the motor-driven valve 454 to the sample line 144. The flow routing plug 452 disposed on the sample line 144 utilizes two fluidic connections 456. The fluidic connections 456 enable the sample line fluid to flow from the sample line 144 to the motor-driven valve 454. The motor-driven valve 454 can thereby act as a sealing valve for the sample line 144 when the fluid flow from the sample line 144 is directed from the sample line 144 to the motor-driven valve 454. In other words, the valve 454 may control the quantity and timing of the fluid flow from the sample line 144. The flow routing plug 452 disposed on the guard line 146 utilizes two fluidic connections 456. The fluidic connections 456 enable the guard line fluid to bypass the motor-driven valve 454.

Figure 25:
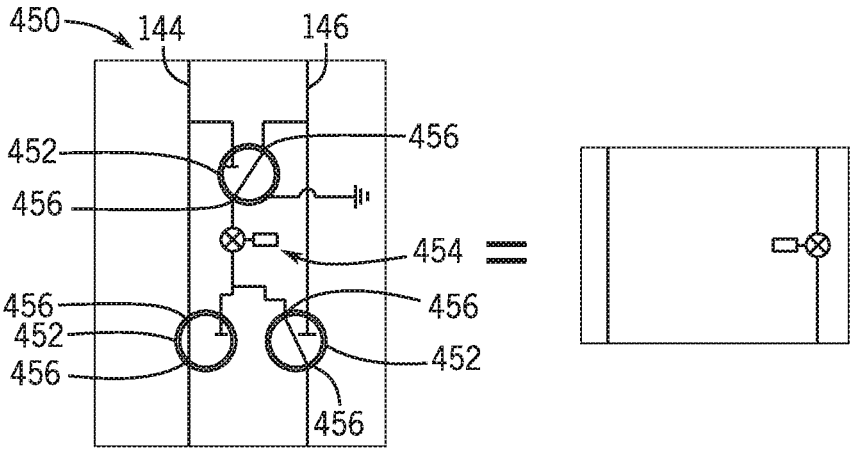
FIG. 25 illustrates a schematic diagram of an embodiment of the flow routing module within the wireline wellsite system.

FIG. 25 illustrates a schematic diagram of an embodiment of the flow routing module 450 within the wireline wellsite system 142. In the illustrated embodiment, the top most flow routing plug 452 utilizes two fluidic connections 456. The fluidic connections 456 are oriented to flow from the motor-driven valve 454 to the guard line 146. The flow routing plug 452 disposed on the sample line 144 utilize two fluidic connections 456. The flow routing plug 452 passes through the sample line 144, thereby bypassing the motor-driven valve 454. The flow routing plug 452 disposed on the guard line 146 utilizes two fluidic connections 456. The fluidic connections 456 enable the guard line fluid to flow from the guard line 146 to the motor-driven valve 454. The motor-driven valve 454 can thereby act as a sealing valve for the guard line 144 when the fluid flow from the guard line 146 is directed from the guard line 146 to the motor-driven valve 454. In other words, the valve 454 may control the quantity and timing of the fluid flow from the guard line 146.

Figure 26:
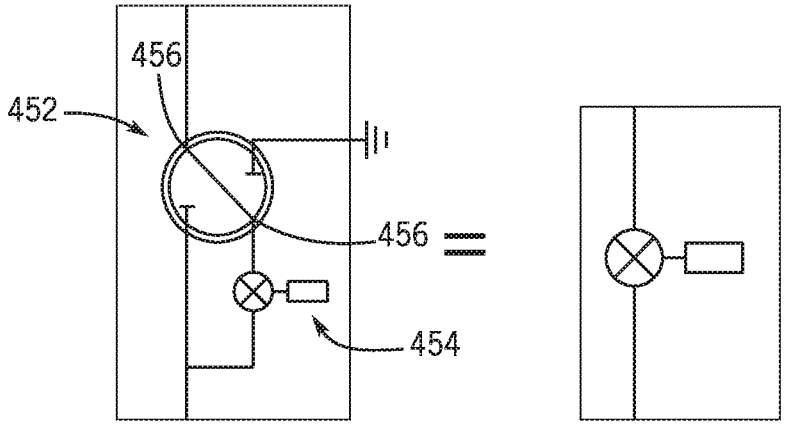
FIG. 26 illustrates a schematic diagram of an embodiment of the flow routing module within the wireline wellsite system.

FIG. 26 illustrates a schematic diagram of an embodiment of the flow routing module 450 within the wireline wellsite system 142. In the illustrated embodiment, the flow routing module 450 is utilized in a single flowline downhole acquisition tool 12. The flow routing module 450 utilizes one flow routing plug 452 and the motor-driven valve 454. The routing plug 452 utilizes two fluidic connections 456. The motor-driven valve 454 can thereby act as a sealing valve for the flowline when the fluid flow from the flowline is directed from the flowline to the motor-driven valve 454. In other words, the valve 454 may control the quantity and timing of the fluid flow from the flowline.

Figure 27:
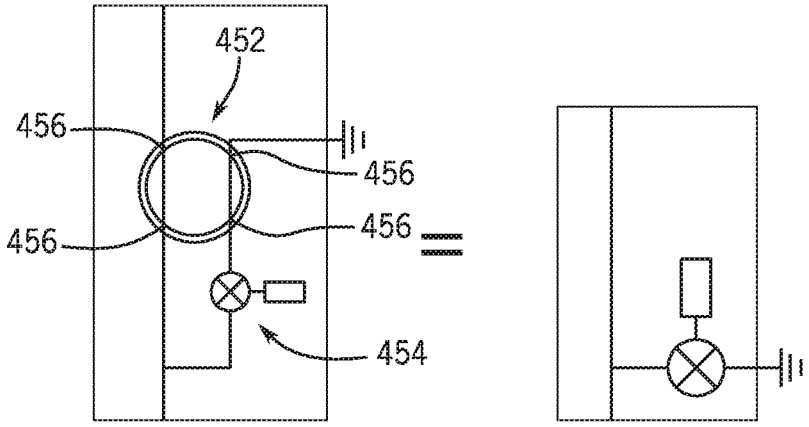
FIG. 27 illustrates a schematic diagram of an embodiment of the flow routing module within the wireline wellsite system.

FIG. 27 illustrates a schematic diagram of an embodiment of the flow routing module 450 within the wireline wellsite system 142. In the illustrated embodiment, the flow routing module 450 is utilized in a single flowline downhole acquisition tool 12. The flow routing module 450 utilizes one flow routing plug 452 and the motor-driven valve 454. The routing plug 452 utilizes four fluidic connections 456. The fluidic connections 456 are oriented to direct a portion of the fluid through the flow routing plug 452 such that the fluid can exit the flow routing plug 452 via the line exit port.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A system, comprising:

a downhole acquisition tool housing configured to receive a fluid that enters a downhole acquisition tool from a first flowline, a second flowline, or both; and a flow control assembly comprising:

a first pump module fluidly coupled to first flowline;

a second pump module fluidly coupled to the second flowline;

a crossover portion disposed between the first pump module and the second pump module, wherein a turnaround module is connected with the crossover portion, wherein the crossover portion is disposed between the turnaround module and an inlet of the first flowline and second flowline, wherein the turnaround module has a valve associated therewith that is selectively adjusted to open an exit port or close an exit port, and wherein when the exit port is opened fluid flows out of the downhole acquisition tool housing and when the exit port is closed fluid is allowed to flow from one of the flow lines to the other flow line, and wherein the flow control assembly is configured to permit discharging the fluid from the first flowline to the second flowline, wherein the flow control assembly comprises one or more tangible, non-transitory, machine-readable media comprising instructions to:

control a valve assembly of a first valve configuration that enables the fluid to flow into the downhole tool via the first flowline toward a first pump module;

control a valve assembly of a second valve configuration that enables the fluid to flow into the downhole tool via the second flowline toward a second pump module; and selectively use the turnaround module or the crossover portion to direct the fluid flow between the first flowline and the second flowline by actuating the valve associated with the turnaround module, the valve associated with the crossover portion, or both, to adjust operation of the downhole acquisition tool.

2. The system of claim 1, wherein selective use of the turnaround module comprises closing a port and a valve associated with the turnaround module, wherein closing the port and the valve associated with the turnaround module enables the fluid flow from the first flowline and the second flowline to be turned in the turnaround module within the downhole acquisition tool by closing the valve.

3. The system of claim 2, wherein the fluid flow is turned in the turnaround module and is rerouted in the downhole tool along the first flowline or the second flowline.

4. The system of claim 1, wherein the selective use of the turnaround module comprises using the first pump module, bypassing the second pump module, and opening a comingle valve when the second pump module is unavailable, wherein the first pump module is configured to pump fluid from the first flowline to collect a sample in a sample chamber.

5. The system of claim 4, wherein the selective use of the turnaround module comprises using the second pump module, bypassing the first pump module, and opening a comingle valve when the first pump module is unavailable, wherein the second pump module is configured to pump fluid from the second flowline to collect a sample in a sample chamber.

6. The system of claim 1, wherein the selective use of the turnaround module comprises closing the valve associated with the turnaround module and closing an exit port associated with the turnaround module to capture a first fluid slug and continuing to operate the pump module to capture a second fluid slug to enable the first fluid slug and the second fluid slug to mix to form a mixed fluid.

7. The system of claim 6, wherein the selective use of the turnaround module comprises measuring one or more fluid properties of the mixed fluid.

* * * * *